US005888704A

United States Patent [19]

Kikuchi

[11] Patent Number: 5,888,704

[45] Date of Patent: Mar. 30, 1999

[54] SILVER HALIDE COLOR PHOTOGRAPHIC LIGHT-SENSITIVE MATERIAL AND A METHOD OF FORMING A COLOR IMAGE

[75] Inventor: Makoto Kikuchi, Kanagawa, Japan

[73] Assignee: Fuji Photo Film Co., Ltd., Kanagawa, Japan

[21] Appl. No.: 937,022

[22] Filed: Sep. 24, 1997

[30] Foreign Application Priority Data

Sep. 24, 1996 [JP] Japan ..... 8-273037

[51] Int. Cl.[6] ..... G03C 8/00; G03C 8/110

[52] U.S. Cl. ..... 430/351; 430/203; 430/380; 430/405

[58] Field of Search ..... 430/351, 350, 430/380, 203, 617, 619, 567, 354, 374, 405

[56] References Cited

U.S. PATENT DOCUMENTS 5,268,262 12/1993 Shibahara et al. ..... 430/506
5,494,789 2/1996 Daubendiek et al. ..... 430/567
5,578,435 11/1996 Ihama ..... 430/501
5,667,945 9/1997 Takeuchi et al. ..... 430/380
5,677,104 10/1997 Hirai et al. ..... 430/203

*Primary Examiner*—Thorl Chea
*Attorney, Agent, or Firm*—Sughrue, Mion, Zinn Macpeak & Seas, PLLC

[57] ABSTRACT

The present invention relates to a silver halide color photographic light-sensitive material which has on a substrate at least one photographic light-sensitive layer comprising a light-sensitive silver halide emulsion containing epitaxial silver halide grains having at least one kind of silver salt epitaxy formed on the surface of silver halide tabular grains acting as a host, a developing agent, a compound capable of forming a dye by a coupling reaction with the oxidation product of said developing agent, and a binder. The present invention provides a silver halide color photographic light-sensitive material which few adverse effects on the environment, and which is well suited for the simple and rapid process, and which provides graininess of good and high-sensitivity, and which is especially excellent in storage life.

11 Claims, No Drawings

SILVER HALIDE COLOR PHOTOGRAPHIC LIGHT-SENSITIVE MATERIAL AND A METHOD OF FORMING A COLOR IMAGE

BACKGROUND OF THE INVENTION

1. Field of the Invention

The present invention relates to a novel silver halide color photographic light-sensitive material for recording images in color photography and a method of forming a color image utilizing the said light-sensitive material.

2. Description of the Related Art

Owing to remarkable development of light-sensitive materials utilizing silver halides, high-quantity color images are now easily obtainable. For example, according to ordinary color photography, a color print is obtained by the process comprising taking a photograph utilizing a color negative film, developing the film, and printing the image information, which is recorded in the color negative film, on color photographic paper in an optical way. Recently, this process has made remarkable progress, and large-scale, color development laboratories, in which a large quantity of color prints are produced in a very efficient way, have spread along with the so-called mini-laboratories which are now in shops and are designed to provide small-scale, relatively small-sized printer processing. Therefore, anybody can enjoy color photography easily.

The color photography, now in common use, reproduces color by the subtractive color process. Generally, a color negative film comprises a transmittable substrate and light-sensitive layers thereon utilizing a silver halide emulsion as a light-sensitive component having a sensitivity to the blue, green or red wavelength region of light, and a so-called color coupler capable of producing a yellow, magenta or cyan dye as a complementary hue of the sensitive wavelength region of the layer and thereby a colored image can be formed by the combination of the above light-sensitive layer capable of forming a dye. A color negative film, which has been exposed while taking a photograph, is developed in a color developer containing an aromatic primary amine developing agent. In this process, the developing agent develops, i.e., reduces the exposed silver halide grains, and the oxidation product of the developing agent, which are formed concurrently with the forgoing reduction, undergoes the coupling-reaction with the color coupler to form a dye. The silver (developed silver) generated by the color development and the unreacted (unexposed) silver halide are removed by means of a bleaching process and fixing process. This creates a color image on the color negative film. Consequently, a color photographic paper which comprises a reflective substrate and light-sensitive layers formed thereon having the same combinations of light-sensitive wave length region and hue to be produced as in the color negative film, is subjected to exposure through the developed negative film, and color-developing, bleaching and fixing processes in the same manner as in the patrone of the negative film to obtain a color print having a color image as a reproduction of an original scene thereon.

Although these systems for forming color prints are widely adopted at the present time, there is a growing demand for a simpler system. First reason for this is that expertise and skilled operation are necessary, due to the requirement of strict control of the composition and the temperature of the processing solution in a processing bath for the above-mentioned procedure consisting of color development, bleaching and fixing. Second reason for this is that closed equipment exclusively for the use in the developing process is often required, due to substances, such as a developing agent and an iron chelate compound, the discharge of which is regulated from the standpoint of environmental protection, contained as a bleaching agent in the processing solution. Third reason for this is that the currently available system does not perfectly fulfill the requirement for a rapid reproduction of image, as the above-mentioned developing process still requires a long time, although the time is shorted by the recent advance in technology.

Based on this background, there has been a strong demand for a simpler and more rapid system which does not utilize the developing agent and bleaching agent now in use for a conventional color image forming system and which accordingly minimizes the adverse effect on the environment.

In recent years, as an attempt to fulfill the above-mentioned requirements, many improved techniques have been proposed. For example, IS & T's 48th Annual Conference Proceedings, pp. 180, discloses a system in which the dye formed in the developing reaction is transferred to a mordant layer and thereafter stripping a light-sensitive material containing developed silver and unreacted silver halide from an image receiving material bearing the mordant layer to separate the developed silver and unreacted silver halide from an image formed by the dye without the use of a bleaching-fixing bath which has been indispensable to a conventional photographic process. However, this technique cannot perfectly solve the environmental problems, because it still needs a developing process by use of a processing bath containing a developing agent.

Fuji Photo Film Co., Ltd. has proposed a Pictrography System which dispenses with a processing solution containing a developing agent. In this system, a small amount of water is supplied to a light-sensitive material containing a base precursor which reacts with water to generate a base. The light-sensitive material and an image receiving material are placed face to face and heated to promote the developing reaction. This system does not use the aforementioned processing bath and, in this regard, is advantageous with respect to environmental protection.

However, this system cannot be used for photographic recording materials, because, in this system, a formed dye is fixed in a dye-fixing layer and the fixed dye in the layer is viewed. Therefore, a photographic light-sensitive material and a method for forming color images which can be used in this system are greatly desired.

On the other hand, high sensitivity, graininess, storage life, and similar properties are required for silver halide emulsions used in a light-sensitive material from the standpoint of high image quality and toughness. Utilization of tabular grains as one form of sensitivity enhancement technology of silver halide emulsions is known. A process for preparation of tabular grains used in conventional liquid development photographic systems and utilization technologies thereof are disclosed in U.S. Pat. Nos. 4,434,226, 4,439,520, 4,414,310, 4,433,048, 4,414,306 and 4,459,353, and Japanese Patent Application Laid-Open (JP-A) Nos. 59-99433, 62-209445 and the like.

In Pictorography System aforementioned, a previously prepared dye is contained in a light-sensitive material and the dye is transferred to an image receiving material to form colored images thereon. However, with this system, a level of resolution equal to that required of photographic material cannot be obtained. From the view point of resolution, a system in which an image is formed not on the image receiving material but on the light-sensitive material is advantageous.

Further, since the previously prepared dye is contained in the light-sensitive material, part of the exposed light is absorbed by the dye (filter effect), which is disadvantageous in terms of sensitivity and results in the sensitivity enhancement required for light-sensitive materials not being obtained. From the view point of sensitivity, the system in which a coupler capable of forming a dye at the time of development by a coupling reaction with an oxidation product of a developing agent is contained in the light-sensitive material is more advantageous than the system in which a dye has been previously formed.

However, as a result of study of the application of a silver halide tabular grain emulsion for the color photographic light-sensitive material containing a coupler and a color developing agent, it was found that the sensitivity of such a light-sensitive material significantly increases during storage. It was also found that the variation in sensitivity at the time of development of the color photographic light-sensitive material containing the silver halide tabular grain emulsion and the color developing agent is larger than the variation in sensitivity at the time of development of conventional light-sensitive materials which development is effected by a processing bath containing a color developing agent.

When the light-sensitive material the sensitivity of which has increased with time after preparation of product is photographed by a camera which determines exposure time automatically, any negative image answering the photographic purpose can not be obtained due to over-exposure.

SUMMARY OF THE INVENTION

As evident from the foregoing, the first object of the present invention is to provide a silver halide color photographic light-sensitive material which has barely any adverse affects on the environment, and which is well suited for simple and rapid process, and which gives high sensitivity and good graininess, as well as excellent storage life. Moreover, it is also an object of the present invention to provide a method for forming an image which can decrease adverse effects on the environment and can simply and rapidly provide a high quality color image without unevenness by using the silver halide color photographic light-sensitive material.

The objects of the present invention as above described were achieved effectively by the present invention as follows:

(1) A silver halide color photographic light-sensitive material comprising a substrate having thereon at least one photographic light-sensitive layer which comprises a light-sensitive silver halide emulsion, a developing agent, a compound capable of forming a dye by a coupling reaction with the oxidation product of the developing agent, and a binder, wherein the light-sensitive silver halide emulsion contains epitaxial silver halide grains in which at least a silver salt epitaxy is formed on the surface of silver bromide or silver iodobromide tabular grains acting as a host, wherein the content of silver chloride contained in the silver salt epitaxy is more than 20 mole %.

(2) a method of forming a color image by heating the silver halide color photographic light-sensitive material at a temperature of from 60° C. to 100° C. for 5 to 60 seconds.

Examples of utilization of emulsions containing epitaxial silver halide grains comprising at least one type of silver salt epitaxy which is formed on the surface of silver halide tabular grains acting as a host for a color photographic light-sensitive material are disclosed in, for example, European Patent Nos. 699,944A, 701,165A, 701,164A, 699,945A, 699,948A, 699,946A, 699,949A, 699,951A, 699,950A, 699,947A, U.S. Pat. Nos. 5,503,971, 5,503,970, 5,494,789, Japanese Patent Application Laid-Open (JP-A) Nos.8-101,476, 8-101,475, 8-101,473, 8-101,472, 8-101,474, 8-69,069.

However, these patented inventions respectively relate to technology for improving sensitivity or contrast of a conventional silver halide color photographic light-sensitive materials which is developed by a processing solution containing a conventional color developing agent in a processing bath. This is different from the present invention which relates to sensitivity, granularity and reduction in sensitization during storage over time.

Accordingly, nowhere is it disclosed that use of a specific emulsion for a silver halide color photographic light-sensitive material which is developed through a color developing agent contained therein leads to high sensitivity, excellent granularity and reduction in sensitization during storage over time.

DETAILED DESCRIPTION OF THE PREFERRED EMBODIMENTS

In the present invention, color reproduction according to a color subtraction process can be basically used for the preparation of a silver halide color photographic light-sensitive material (herein after referred to as "light-sensitive material" upon occasion) to be used for the reproduction of an original scene as a color image. That is, the color information of the original scene can be recorded by means of a color negative film having at least three light-sensitive layers, which have a sensitivity to the blue, green or red wavelength region of light, respectively, and are incorporated, respectively, with a color coupler capable of producing a yellow, magenta or cyan dye as a complementary color of the sensitive wavelength region of the layer. Through the thus obtained color image, color photographic paper, which has a wavelength sensitivity to hue relationship identical to that of the color negative film, is optically exposed to thereby reproduce the original scene. Alternatively, it is also possible to reproduce an image for enjoyment by reading out by means of a scanner the information of the color image obtained by taking a photograph of an original scene.

The light-sensitive material of the present invention can comprise three or more light-sensitive layers, each of which has a sensitivity to light of a wavelength different to the other two. In addition, the relationship between the sensitive wavelength region and hue of layer may be different from the complementary color relationship described above. In this patrone, it is possible to reproduce the original color information by image processing, e.g., color conversion, of the image information which has been read out as described above.

In a color negative conventionally used in photography, in order to attain a desired level of granulation, a light-sensitive silver halide emulsion has been improved and a so-called DIR coupler which releases, by the reaction with the oxidation product of a developing agent, a compound capable of inhibiting the development has been used. The light-sensitive material according to the present invention provides an excellent level of granulation even if DIR coupler is not used in the light-sensitive material. If the light-sensitive material according to the present invention contains DIR coupler, the level of granulation is further improved.

An explanation is given below on the light-sensitive silver halide emulsion used in the present invention.

As used herein the term "silver halide tabular grain" (hereinafter referred to as "tabular grain") means a silver halide grain having two opposite parallel principal planes. The tabular grain used in the present invention has one twin plane or more than two parallel twin planes. As herein used, the twin plane means a plane (111) on both sides of which ions on all the lattice points are mirror images of each other. The tabular grain has at least one pair of parallel outer surfaces and its planar shape is a triangle, a hexagonal or a roundish triangle or a roundish hexagonal.

In the light-sensitive silver halide emulsion used in the present invention, the percentage of the projected area takes up by the tabular grains in the total projected area of all the grains is preferably 100 to 50%, more preferably 100 to 80%, most preferably 100 to 90%. When the percentage of the projected area of tabular grain in the total projected area of all the grains is less than 50%, the merits of the tabular grains (improvements in sensitivity, granularity, and sharpness) cannot completely be taken advantage of.

The average grain thickness of tabular grains used in the present invention is preferably 0.01 to 0.5 μm, more preferably 0.03 to 0.4 μm, and most preferably 0.03 to 0.3 μm. As used herein, the average grain thickness means the arithmetic mean grain thickness of all the tabular grains in the light-sensitive silver halide emulsion. When the average grain thickness is less than 0.01 μm, the pressure resistance is reduced. On the other hand, when the average grain thickness is more than 0.5 μm, the merits of tabular grain cannot completely be taken advantage of.

The average diameter of circles each having the same area as a projected area of a tabular grain used in the present invention is preferably in the range of 0.3 to 5 μm, more preferably in the range of 0.4 to 4 μm, and most preferably 0.5 to 3 μm. As used herein, the average diameter of circles each having the same area as a projected area of a tabular grain means the arithmetic mean diameter of circles each having the same area as a projected area of a tabular grain contained in the light-sensitive silver halide light-sensitive emulsion. All of the grains in the silver halide emulsion are used to calculate the average diameter. When the above average diameter is less than 0.3 μm, the effects of the present invention become hard to obtain. On the other hand, when the average diameter exceeds 5 μm, the pressure resistance is reduced.

In the light-sensitive silver halide emulsion used in the present invention, the average aspect ratio of all the tabular grains is preferably in the range of 2 to 100, more preferably in the range of 3 to 50, and most preferably in the range of 4 to 40. As used herein, the aspect ratio is a value obtained by dividing the diameter of circles each having the same area as the projected area of a silver halide grain by the grain thickness. The average aspect ratio means the arithmetic mean of the aspect ratios of all the tabular grains contained in the light-sensitive silver halide emulsion. When the average aspect ratio is less than 2, the merits of tabular grains cannot completely be taken advantage of. On the other hand, when the average aspect ratio is more than 100, the pressure resistance is reduced. One example of the measuring methods of the aspect ratio is the replica method in which the diameter of a circle having the same area as the projected area of the grain and the grain thickness are determined by using a photograph through a transmission electron microscope to obtain the aspect ratio of the grain. In this case, the thickness is calculated from the length of the shadow of the replica.

In the present invention, while the grain thickness and aspect ratio may be selected within the above range, it is preferable to make use of tabular grains having a low grain thickness and a high aspect ratio. There are various methods of preparing such grains. For example, a method described in U.S. Pat. No. 5,494,789 may be utilized.

In order to prepare tabular grains having a high aspect ratio, it is important to form a small nucleus having a twin plane. It is, therefore, preferable (1) to form the nucleus with a reduced amount of gelatin at low temperature, high pBr, and low pH, or (2) to form the nucleus by using gelatin with a low methionine content, gelatin of low molecular weight, or a phthalated gelatin derivative, or (3) to form the nucleus in a short time.

After nucleation, only tabular grain nuclei (nuclei having multi parallel twin planes) are made to grow by physical ripening. Normal crystal nuclei, nuclei having a single twin plane and nuclei having multi parallel twin planes are eliminated such that only the nuclei having multi parallel twin planes remain.

Then, a soluble silver salt and soluble halide are put into a reaction vessel to grow grains. An emulsion containing tabular grains is prepared in this way.

In order to supply silver and halides for growing grains, it is preferable to add fine silver halide grains which have been previously and independently prepared or are prepared simultaneously in a different reaction vessel as silver and halides.

In the light-sensitive silver halide emulsion used in the present invention, the total projected area of hexagonal tabular grains in which the ratio of the length of the longest side to the length of the shortest side is in the range of 2 to 1 is preferably in the range of 100 to 50%, more preferably in the range of 100 to 70%, and most preferably in the range of 100 to 90% on the basis of the total projected area of all the grains contained in the light-sensitive silver halide emulsion. The inclusion of tabular grains other than the above hexagonal ones is not preferable from the viewpoint of grain homogeneity.

It is preferable that the light-sensitive silver halide emulsion of the present invention is a monodisperse system.

The coefficient of variation of grain diameter distribution of all the silver halide grains is preferably in the range of 35 to 3%, more preferably in the range of 30 to 3%, and most preferably in the range of 20 to 3%. A coefficient of variation exceeding 35% is not preferable from the viewpoint of grain homogeneity. As used herein, the coefficient of variation of the grain diameter distribution means a value obtained by dividing the standard deviation of diameters of spheres which have equivalent grain volumes by the average diameter of spheres which have equivalent grain volumes.

Next, an explanation is given on the merits of tabular grains.

The tabular grains are advantageous for sensitivity and developing speed, since surface area is large and an amount of the sensitizing dye which is adsorbed by the tabular grains are large compared to normal crystals having the same volume.

Accordingly, when comparing with the same sensitivity, the volume of tabular grains is smaller than that of normal crystals. When comparing with the same sensitivity and the same amount used (in weight), the number of tabular grains used is greater than that of the normal crystals used. Therefore, the number of points at which development can start increases and graininess, which is an important quality in light-sensitive material, is excellent.

Further, the amount of silver coated may be reduced due to excellent graininess and radiation fogging which is a disadvantageous problem for high sensitive photographic light-sensitive material may be significantly inhibited.

Further, the reduction in the amount of coated silver is effective in decreasing haze which is responsible, at the time of scanning, for degradation of images recorded on a light-sensitive material which has not been subjected to a fixing process after development.

The tabular grains may enable the layer of light-sensitive material to be thin and may be excellent in sharpness, since they are oriented at the time of coating.

These effects may be obtained by making use of tabular grains.

In the present invention, an epitaxial silver halide grain having at least one type of silver salt epitaxy formed on the surface of the tabular grain acting as a host (hereinafter referred to as the "host tabular grain") is used.

As a halogen composition of the host tabular grain is made use of silver bromide, silver chlorobromide, silver iodobromide, or silver chloroiodobromide and silver bromide or silver iodobromide may be preferably used.

When the host tabular grain contains an iodide or chloride other than silver iodide and silver chloride, such an iodide or chloride may be uniformly distributed in the grain or may be localized.

The range of content of silver iodide in the host tabular grain used in the present invention is preferably in the range of 0 to 20 mole %, more preferably in the range of 0 to 12 mole %, and most preferably in the range of 0 to 10 mole %. It is preferable for a light-sensitive material to include silver iodide so as to increase the adsorption of dyes and so as to increase the intrinsic sensitivity. However, a silver iodide content exceeding 20 mole % is not preferable due to reductions in developing speed.

The coefficient of variation of the distribution of content of silver iodide among emulsion grains used in the present invention is preferably 0 to 30%, more preferably in the range of 0 to 25%, and more preferably in the range of 0 to 20%. The coefficient of variation exceeding 30% is not preferable from the viewpoint of grain homogeneity. The content of silver iodide of each emulsion grain may be measured by analyzing the composition of each grain by means of an X-ray microanalyser. As used herein the term coefficient of variation of the distribution of content of silver iodide means a value obtained by dividing the distribution (standard deviation) of content of silver iodide of each grain by the average content of silver iodide.

In the present invention, it is preferable to form silver salt epitaxy at selected sites on the surface of host tabular grains and it is more preferable to form it specifically on the corners or edges (on side surfaces and on each side of grains when the tabular grains are looked at from above).

The silver salt epitaxy is considered to provide chemically sensitized sites and to act as an electron-trap forming effective latent images, and contributes to increasing photographic sensitivity.

It is, therefore, important to restrict the site on which the silver salt epitaxy is to be formed for inhibition of dispersion of latent images in grains and for homogeneous intra-grain chemical sensitization.

In the present invention, it is preferable to form the silver salt epitaxy uniformly on selected sites on the surface of host tabular grains.

Examples of a method of site direction of silver salt epitaxy include a method in which silver iodide is contained in host grains, and the method disclosed in U.S. Pat. No. 4,435,501 in which host grains are made to adsorb a spectrally sensitizing dye (for example, cyanine dye) or an amino compound (for example, adenine) prior to the formation of the silver salt epitaxy. These methods are preferably used in the present invention.

It is also preferable to add iodide ions prior to the formation of the silver salt epitaxy to cause sedimentation on the host grains.

In the present invention, these site direction methods may be suitably selected or they may be used in combinations.

The occupying ratio of area of the silver salt epitaxy to the surface area of the host tabular grain is preferably in the range of 1 to 50%, more preferably in the range of 2 to 40%, and most preferably in the range of 3 to 30%. An occupying ratio of less than 1% or more than 50% is not preferable, since the effects of the present invention become hard to obtain.

The proportion of the amount of the silver in the silver salt epitaxy with respect to the total amount of silver in the silver halide tabular grains is preferably in the range of 0.3 to 50 mole %, more preferably in the range of 0.3 to 2 5 mole %, and most preferably in the range of 0.5 to 15 mole %. A proportion of less than 0.3% or more than 50% causes the effects of the present invention to become hard to obtain.

In the present invention, while the composition of the silver salt epitaxy may be suitably selected from silver halides containing chloride ions, bromide ions or iodide ions, a silver halide containing at least chloride ions is preferable.

In the case of a silver chloride-containing epitaxy which is a silver halide epitaxy preferably used in the present invention, an epitaxy may be easily formed since the silver chloride structure is a face-centered cubic lattice having a structure similar to the structure of silver bromide and silver iodobromide which are host grains. There is, however, a difference between lattice spaces formed by two types of silver halides, by which difference may be formed an epitaxy junction contributing to an increase in photographic sensitivity.

In the present invention, the content of silver chloride contained in the silver halide epitaxy is higher than the content of silver chloride contained in the host tabular grains by preferably at least 10 mole %, more preferably more than 15 mole %, and most preferably more than 20 mole %. When the difference between both is less than 10 mole %, the effects of the present invention become hard to obtain.

It is preferable to introduce iodide ions into the silver halide epitaxy for high sensitization.

In the present invention, the content of silver contained as silver iodide in the silver halide epitaxy with respect to the total amount of silver in the silver halide epitaxy is preferably at least 1 mole %, and more preferably at least 1.5 mole %.

When halide ions are introduced into the silver halide epitaxy, it is preferable to introduce halide ions in the order of the composition of the epitaxy in order to increase the amount introduced.

For example, in order to form an epitaxy in which a high quantity of silver chlorides are contained in the internal portion of the epitaxy and a high quantity of silver bromides are contained in the intermediate portion of the epitaxy and a high quantity of silver iodides are contained in the outer portion of the epitaxy, halide ions such as chloride ions, bromide ions and iodide ions are added in that order to make the solubility of the silver halides containing the halide ions added lower than that of the other silver halides in order to precipitate those silver halides and to form a layer rich in the said silver halide.

Silver salts other than silver halides, such as silver rhodanate, silver sulfide, silver selenide, silver carbonate, silver phosphate and silver salts of organic acid may be contained in the silver salt epitaxy.

As methods of forming the silver salt epitaxy are known various types of methods involving the addition of halide ions, addition of an aqueous solution of silver nitrate and a aqueous solution of halide by double jet method, and addition of fine grains of a silver halide, and the like. In the present invention, these methods may be suitably selected or they may be used in combination.

The temperature, pH, and pAg of system, type and concentration of the protective colloid such as gelatin, and presence or absence, type and concentration of solvents for silver halide, and the like. at the time of formation of silver salt epitaxy, may be suitably selected.

An emulsion of silver halide tabular grain containing a silver salt epitaxy formed on the surface of host tabular grains is disclosed in, for example, Europe Patent Nos. 699,944A, 701,165A, 701,164A, 699,945A, 699,948A, 699,946A, 699,949A, 699,951A, 699,950A, 699,947A, U.S. Pat. Nos. 5,503,971, 5,503,970, 5,494,789, Japanese Patent Application Laid-Open (JP-A) Nos. 8-101,476, 8-101,475, 8-101,473, 8-101,472, 8-101,474, 8-69,069. The method of forming grains described in these publications may be used in the present invention.

When tabular grains of less than 0.07 $\mu$m thickness described in the above patents are used as the host grains of the present invention for preserving the host grain configuration or for giving site direction to the edges and corners of the grains of silver salt epitaxy, the content of silver iodide in the outer region of the host grains (the region which is the top formed layer and forms edge and corner portions of the grains) is preferably higher than that in the central region by at least one mole %.

The content of silver iodide in the outer region at that time is preferably in the range of 1 to 20 mole %, and more preferably in the range of 5 to 15 mole %. When the content of silver iodide in the outer region is less than 1 mole %, the effects above described become hard to obtain, and when it is more than 20 mole %, the developing speed is reduced.

In this case, the proportion of the total amount of, silver in the outer region containing silver iodide with respect to the total amount of silver in the host grain is preferably in the range of 10 to 30%, and more preferably in the range of 10 to 25%. A proportion of less than 10% or more than 30% is not preferable because the above effects become difficult to realize.

The content of silver iodide in the central region at that time is preferably in the range of 0 to 10 mole %, more preferably in the range of 1 to 8 mole %, and most preferably in the range of 1 to 6 mole %. A content of silver iodide in the outer region of more than 10 mole % is not preferable because the developing speed is reduced.

A dopant may be added to the light-sensitive silver halide emulsion used in the present invention. As used herein "dopant" means a substance other than the silver and halide ions contained in the face-centered cubic lattice structure of the silver halide tabular grains used in the present invention.

Any conventional dopants known to be effective in face-centered cubic lattice structures of silver halides may be used in the present invention and may be widely selected from the period and the group of the periodic table.

A value of the depth of the electron traps caused by the metal ions and metal complex ions used in the present invention may be obtained by means of dynamic measurement using ESR. See R. S. Eachus, R. E. Grave and M. T. Olm, Phys. Stat. Sol (b), vol. 88, (1978), p.705.

The depth of the electron trap may vary depending on the central metal ion, the ligand, the symmetry of the point group of the complex (Oh, D4h, C4v, etc.), and the halogen composition of the substrate. The depth of the electron trap may be determined depending on whether or not the energy level of the lowest non-occupied orbital of the electron of the central metal ion or metal complex ion is lower or higher than that of the minimum conduction band of the silver halide.

When the energy level of the lowest non-occupied orbital of the metal ion is higher than that of the conduction band of the silver halide, a shallow electron trap may be obtained, since an electron is loosely bound by the Coulomb force of the central metal ion.

When the energy level of the lowest non-occupied orbital of the metal ion is lower than that of the conduction band of the silver halide, the difference in energy levels of the conduction band and the lowest non-occupied orbital of the metal ion corresponds to the depth of the electron-trap.

The depth of shallow electron trap is preferably less than or equal to 0.2 eV, and more preferably less than or equal to 0.1 eV. A metal ion or metal complex ion which may become a shallow electron trap is $Pb^{2+}$, $[M(CN)_x L_y N_z]$, wherein M is selected from the group consisting of $Fe^{2+}$, $Ru^{2+}$, $Os^{2+}$, $Co^{3+}$, $Ir^{3+}$ and $Re^{+}$, x is an integer of from 4 to 6, L and N are an inorganic ligand such as halide ions, (for example, a fluoride ion, a chloride ion, a bromide ion), $SCN^-$, $NCS^-$, $H_2O$, or an organic ligand such as pyridine, phenanthroline, imidazole, pyrazol. Y and z are determined so as to satisfy the equation x+y+z=6. The coordination number is usually 6 when a ligand is present.

The depth of relatively deep electron traps is preferably more than or equal to 0.35 eV, and more preferably more than or equal to 0.5 eV.

Metal ions or metal complex ions which may become such an electron trap may be Ir, Rh, Ru, and Pd having halide ion ligands or Rhodanide ion ligands, Ru having more than or equal to one type of nitrosyl ligand, and Cr having cyan ligands. For example, $[IrCl_2]^{3-}$, $[IrBr_6]^{3-}$, $[Ir(SCN)_6]^{3-}$, $[IrI_6]^{3-}$, $[RhCl_5(H_2O)]^{2-}$, $[RhCl_4(H_2O)_2]^-$, $[RuCl_5(NO)]^{2-}$, $[Cr(CN)_6]^{3-}$, $[RhCl_6]^{3-}$, $[RhBr_6]^{3-}$, $[PdCl_6]^{5-}$ and the like may be preferably used.

An amount of the above described metal ion or metal complex ion added is approximately in the range of $10^{-9}$ to $10^{-2}$ mole per one mole of silver halide.

In the silver halide grains, the metal ions and/or metal complex ions (hereinafter to be referred to as "metal ions etc.") may be incorporated uniformly or locally within the grains, or incorporated on the surface of grains in an exposed state, or they may be localized in the vicinity of the surface of the grains without being exposed to the surface of the grains.

Epitaxial grains may be crystals of substrate or crystals of junctions. In light-sensitive silver halide emulsion having a plurality of phases each containing different halogen composition, metal ions to be incorporated may be changed corresponding to the halogen compositions.

Addition of the above described metal ions may be carried out (1) by mixing a solution of the metal salt with an aqueous solution of silver salt or an aqueous solution of a halide compound used in grain formation, and continuously adding the resultant mixture to another mixture containing other components to be used in the grain formation, or (2) by adding, to an emulsion, light-sensitive silver halide fine grains in which the metal ions etc. are doped, or (3) by adding directly, to an emulsion, an aqueous solution of the metal salt containing the metal ions prior to, during, or after grain formation.

When the metal salt is dissolved in a suitable solvent such as water, methanol, acetone, or the like, a method of adding an aqueous solution of hydrogen halide (for example, HCl, HBr), thiocyanic acid or salts thereof, or alkali halide (for example, KCl NaCl, KBr, NaBr, etc.) for stabilization of the solution. It is, further, preferable in the stabilization of the solution to add, if necessary, acid, alkali, or the like.

The amount of said metal ions in the light-sensitive silver halide emulsion may be measured by, for example, atomic-absorption spectroscopy, polarization Zeeman spectroscopy, ICP analysis, etc. The presence of ligands of metal complexes ions such as $CN^-$, $SCN^-$, $NO^-$, etc. in the light-sensitive silver halide emulsion may be confirmed by IR-absorption (especially, FT-IR).

The tabular grains in the light-sensitive silver halide emulsion used in the present invention may have dislocation lines. As used herein, the term dislocation lines means linear lattice defects present in the boundary, on the slip planes of crystals, between a region which has already slipped and a region which has not yet slipped.

With respect to the dislocation lines of silver halide crystals, there are references such as (1) C. R. Berry, J. Appl. Phys., 27,636(1956), (2) C. R. Berry, D. C. Skilman, J. Appl. Phys., 35,2165(1964), (3) J. F. Hamilton, Phot. Sci. Eng., 11,57(1967), (4) T. Shiozawa, J. Soc. Phot. Sci. Jap., 34,16 (1971), (5) T. Shiozawa, J. Soc. Phot. Sci. Jap., 35,213 (1972), etc. The dislocation lines of silver halide crystals may be analyzed by x-ray diffractiometry or by direct observation method under a low temperature transmission electron microscope.

When the dislocation lines are directly observed under a transmission electron microscope, a sample of silver halide grain is picked up from light-sensitive silver halide emulsion meticulously so as not to apply pressure that causes the said dislocation lines in the silver halide grains, and is put on a mesh for electron microscopic observation to observe the sample by the transmission method while the sample is cooling to prevent damage by electron rays (for example, print-out).

In this case, the thicker the silver halide grains become, the less electron beams transmit. Clear observation may be achieved by making use of a high-pressure type electron microscope (for example, more than or equal to 200 kV for 0.25 $\mu$m in thickness).

Japanese Patent Application Laid-Open (JP-A) No. 63-220,238 discloses an invention related to introducing dislocation lines into silver halide grains.

It is shown that tabular grains into which dislocation lines have been introduced are superior to those without dislocation lines in photographic characteristics such as sensitivity, reciprocity law, etc.

In tabular grains, the position and number of dislocation lines of each grain observed from the vertical direction to the principal plane may be obtained from photography of grains taken by the aforesaid electron microscope.

When tabular grains in the light-sensitive silver halide emulsion used in the present invention have dislocation lines, the dislocation lines may be introduced optionally into the apex or fringe portions of grains or over the whole principal plane, but it is particularly preferable to restrict them to the fringe portion.

As used herein, the term "fringe portion" refers to the outer periphery of the tabular grain, and specifically, the portion of the grain at the outer side of a line which is determined as follows. A plurality of lines are drawn from the center of the grain, and for each line, the content of silver iodide at each of plural points along the line is measured. A graph is prepared illustrating the distribution of the silver iodide content along the length of the line. The graphed distribution is observed from the point corresponding to the outermost end of the line (i.e., the end opposite the center), and the point at which the distribution first intersects a line representing the average silver iodide content in the graph is noted. The position of the line drawn in the grain which position corresponds to this intersection is noted. This process is repeated for each line, and the determined positions are connected by a line. The portion of the grain at the outer side of this line is known as the fringe portion.

In the present invention, when the tabular grain has dislocation lines, the density of said dislocation lines is optional and may be suitably selected from, for example, more than or equal to 10 lines, 30 lines 50 lines, or the like per grain.

Next, an explanation is given below on the light-sensitive silver halide emulsion containing epitaxial silver halide grains having at least one type of silver salt epitaxy formed on the surface of silver halide tabular grains acting as a host and other light-sensitive silver halide emulsion to be used in combination therewith. Hereinafter, both emulsions are referred to as "silver halide emulsion".

A silver halide emulsion can be selected from those prepared by the methods described, for example, in U.S. Pat. No. 4,500,626, column 50, U.S. Pat. No. 4,628,021, Research Disclosure (hereinafter abbreviated as RD) No. 17,029(1978), RD No. 17,643 (December 1978), pp. 22–23, RD No. 18,716 (November 1979), pp. 648, RD No. 307,105 (November 1989), pp. 863–865, Japanese Patent Application Laid-Open (JP-A) Nos. 62-253,159, 64-13,546, 2-236, 546 and 3-110,555, P. Glafkides, Chimie et Physique Photographique, Paul Montel, 1967, G. F. Duffin, Photographic Emulsion Chemistry, Focal Press, 1966, and V. L. Zelikman et al., Making and Coating Photographic Emulsion, Focal Press, 1964.

For general silver halide grain formation, reference will be made, for example, to P. Glafkides, Chimie et Physique Photographique, Paul Montel, 1967, G. F. Duffin, Photographic Emulsion Chemistry, Focal Press, 1966, V. L. Zelikman et al., Making and Coating Photographic Emulsion, Focal Press, 1964; and the like. That is, an employable method may be selected from an acidic method, a neutral method and an ammonia method. Further, any method selected from a single jet method, a double jet method and a combination thereof may be used as a method for reacting a soluble silver salt with a soluble halides. A double jet method is preferable for obtaining a monodisperse emulsion.

An reversed mixing method in which grains are formed in the presence of an excess of silver ion can also be employed. A so-called controlled double jet method in which pAg of the liquid phase for the formation of silver halide is kept constant can also be employed as a double jet method.

Meanwhile, the concentrations, amounts to be added and adding rates of the silver salt and halogen salt may be increased in order to accelerate the growth of the grains (Japanese Patent Application Laid-Open (JP-A) Nos. 55-142,329 and 55-158,124 and U.S. Pat. No. 3,650,757).

The stirring of the reaction mixture may be effected by any known method. Further, the temperature and pH of the reaction mixture during the formation of silver halide grains may be selected depending on the purpose. The pH is preferably in the range of 2.2 to 7.0, and more preferably 2.5 to 6.0.

As a protective colloid used at the time of preparation of the emulsion in the present invention, a gelatin may be preferably used, but other hydrophilic binders may also be used. The hydrophilic binders may be used singly or in combination with gelatin. Examples of the hydrophilic binders include, for example, derivatives of gelatin, graft polymers of gelatin and other polymers, proteins such as albumin, casein, and the like, cellulose derivatives such as hydroxyethyl cellulose, cellulose sulfate, and the like, sodium alginate, derivatives of starch, polysaccharides, carrageenans, synthetic hydrophilic polymers such as homopolymers and copolymers (polyvinyl alcohol, modified alkyl polyvinyl alcohol, polyvinyl/N-pyrrolidone, polyacrylic acid, polymethacrylic acid, polyacrylamide, polyvinyl imidazole, polyvinyl pyrazole) and thioether polymers described in U.S. Pat. No. 3,615,624.

As the gelatin, derivatives of gelatin such as lime-treated gelatin, acid-treated gelatin, delimed gelatin, phthalated gelatin, carbamoyl gelatin, esterified gelatin or low molecular weight gelatin may be preferably used at the time of formation of tabular grains. It is also known that gelatin treated with oxidizing agents such as hydrogen peroxide is effective at the time of formation of tabular grains. A gelatin treated with an enzyme described in Bull. Soc. Photo. Japan. No. 16, p.30 (1966) may be used as low molecular weight gelatin. A hydrolysis or enzyme decomposition product of gelatin may also be used.

It is preferable to use a solvent for silver halide at the time of preparation of the silver halide emulsion. Examples of a solvent for silver halide include thiocyanates (described in U.S. Pat. Nos. 2,222,264, 2,448,534, and 3,320,069), thioether compounds (described in U.S. Pat. Nos. 3,271,157, 3,574,628, 3,704,130, 4,297,439, and 4,276,347), thion compounds (described in Japanese Patent Application Laid-Open (JP-A) Nos. 53-144,319, 53-82,408, and 55-77,737), imidazole compounds (described in Japanese Patent Application Laid-Open (JP-A) No. 54-100,717), benzimidazole (described in Japanese Patent Application Publication (JP-B) No. 60-54,662) and amine compounds (described in Japanese Patent Application Laid-Open (JP-A) No. 54-100,717).

Ammonia may be used in combination with the solvent for silver halide in an amount that does not produce adverse effects. Nitrogen-containing compounds as described in Japanese Patent Application Publication (JP-B) No. 46-7,781 and Japanese Patent Application Laid-Open (JP-A) Nos. 60-222,842 and 60-122,935 may be added at the time of forming silver halide grains. Examples of solvents for silver halide are described on pages 12 to 18 of Japanese Patent Application Laid-Open (JP-A) No. 62-215,272.

Thiosulfonates, dichalcogen compounds described in U.S. Pat. Nos. 5,219,721 and 5,364,754, lipoic acid, cysteine, elemental sulfur or an inorganic metal complex such as a cobalt ammonium complex may be added to an emulsion during and/or after formation of grains.

In the step of formation of silver halide grains or physical ripening, metal salts (including complexes) may coexist. Examples of metal salts include salts or complexes of cadmium, zinc, thallium, platinum, gallium, copper, nickel, manganese, indium, tin, calcium, strontium, barium, aluminum, bismuth, etc. These compounds may be used singly or in a combination of more than or equal to two types thereof. These compounds may be added approximately in the range of $10^{-9}$ to $10^{-3}$ mole per mole of silver halide. These metals may be preferably used as water-soluble salts such as an ammonium salt, acetate, nitrate, sulfate, phosphate, hydroxide, a six-coordinate complex, a four-coordinate complex, and the like. Bromide ions, chloride ions, cyanide ions, nitrosyl ions, thiocyanide ions, thionitrosyl ions, water, ammonium, oxo, carbonyl, and the like. and a combination thereof may be preferably used as a complex ion and coordinate compound. The amount of addition depends on the object, but may be, in general, in the range of $10^{-9}$ to $10^{-2}$ per mole of silver halide. These metal salts may be incorporated uniformly in silver halide grains, or localized on the surface or inside of grains. For example, these metal salts may be incorporated in a phase where silver bromide grains are localized or in a substrate of grains containing silver chloride in high concentration. Addition of these compounds may be carried out (1) by mixing a solution of the metal salt with an aqueous solution of silver salt or an aqueous solution of a halide compound used in grain formation, and continuously adding the resultant mixture to another mixture containing other components to be used in the grain formation, or (2) by adding, to an emulsion, silver halide fine grains in which the metal ions are doped, or (3) by adding directly, to an emulsion, an aqueous solution of the metal salt prior to, during, or after grain formation.

It may be advantageous to add chalcogenide compounds as described in U.S. Pat. No. 3,772,031 during a preparation of emulsion. A part from S, Se, and Te, cyanate, thiocyanate, selenocyanate, carbonate, phosphate or acetate may be present.

In the process for preparing the light-sensitive silver halide emulsion used in the present invention, it is preferable that a salt removing process be conducted in order to remove excessive salt. For the removal of salt, employable methods include a Noodle water-washing method in which a salt is removed by the gelation of gelatin and a floculation method which utilizes such material as an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelatin, aromatic-acylated gelatin and aromatic-carbamoylated gelatin). A floculation method is usually preferably used.

A light-sensitive silver halide emulsion is normally a chemically sensitized silver halide emulsion. In the present invention, a sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, Japanese Patent Application Laid-Open (JP-A) Nos. 3-110,555 and 5-241,267). A chemical sensitization according to any of the above-mentioned methods can be effected in the presence of a nitrogen-containing heterocyclic compound (Japanese Patent Application Laid-Open (JP-A) No. 62-253,159). Besides, an anti-fogging agent, which is described later, may be added to a silver halide emulsion after the chemical sensitization thereof. More concretely, the methods, which are described in Japanese Patent Application Laid-Open (JP-A) Nos. 5-45,833 and 62-40,446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is in the range of 1 mg to 10 $g/m^2$.

In order to impart color-sensitivity, such as green-sensitivity or red-sensitivity, to the light-sensitive silver halide, the light-sensitive silver halide emulsion is spectrally sensitized by means of a methine dye or the like. Further, if necessary, a blue-sensitive emulsion may be spectrally sensitized in order to enhance sensitivity to the light of the blue color region.

Examples of employable dyes include cyanine dyes, merocyanine dyes, complex cyanine dyes, complex merocyanine dyes, holopolar cyanine dyes, hemicyanine dyes, styryl dyes and hemioxonol dyes.

More concrete examples of these sensitizing dyes are disclosed, for example, in U.S. Pat. No. 4,617,257 and Japanese Patent Application Laid-Open (JP-A) Nos. 59-180, 550, 64-13,546, 5-45,828 and 5-45,834.

Although these sensitizing dyes may be used alone, they may also be used in a combination thereof. A combination of these sensitizing dyes is often used particularly for supersensitization or for wavelength adjustment of spectral sensitization.

The light-sensitive silver halide emulsion used in the present invention may contain a compound which is a dye having no spectral sensitization effect itself or a compound substantially incapable of absorbing a visible light but which exhibits a supersensitizing effect (e.g., compounds described in U. S. Pat. No. 3,615,641 and Japanese Patent Application Laid-Open (JP-A) No. 63-23,145).

The above-mentioned sensitizing dye can be added to the emulsion at the stage of chemical aging or thereabout, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent, such as methanol, a dispersion in gelatin or solution containing a surfactant. The amount to be added is generally in the range of $10^{-8}$ to $10^{-2}$ mol based on 1 mol of silver halide.

The aforementioned or other additives may be added to the light-sensitive silver halide emulsion used in the present invention in accordance to a purpose. Details of the additives are described in the aforementioned RD No. 17,643, RD No. 18,716 and RD No. 307,105, the relationship in the description is shown below.

| Kinds of additives: | RD17, 643 | RD18, 716 | RD307, 105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC ~ pp. 649, RC | pp. 866–868 |
| 4. Brightening agent | pp. 24 | pp. 648, RC | pp. 868 |
| 5. Anti-fogging agent/Stabilizer | pp. 24–25 | pp. 649, RC | pp. 868–870 |
| 6. Light absorber/ Filter/Dye/ Ultraviolet ray absorber | pp. 25–26 | pp. 649, RC ~ pp. 650, LC | pp. 873 |
| 7. Dye image stabilizer | pp. 25 | pp. 650, LC | pp. 872 |
| 8. Film hardener | pp. 26 | pp. 651, LC | pp. 874–875 |
| 9. Binder | pp. 26 | pp. 651, LC | pp. 873–874 |
| 10. Plasticizer/ Lubricant | pp. 27 | pp. 650, RC | pp. 876 |
| 11. Coating aid/ Surfactant | pp. 26–27 | pp. 650, RC | pp. 875–876 |
| 12. Anti-static agent | pp. 27 | pp. 650, RC | pp. 876–877 |
| 13. Matting agent | | | pp. 878–879 |

(RC: right column, LC: left column)

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds described in U.S. Pat. No. 4,500,626, columns 52–53. The silver acetylide, which is described in U. S. Pat. No. 4,775,613, is also useful. These silver salts may be used alone or in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 $g/m^2$, and preferably 0.1 to 4 $g/m^2$, based on the weight of silver.

The binder for a constituent layer of the light-sensitive material is preferably a hydrophilic material, examples of which include those described in the aforesaid Research Disclosure and in Japanese Patent Application Laid-Open (JP-A) No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and Japanese Patent Application Laid-Open (JP-A) No. 62-245,260, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate (e.g., SUMIKAGEL L-5H manufactured by Sumitomo Chemical Co., Ltd.). These binders may be used alone or in a combination of two or more of them. Particularly, a combination of gelatin and any of the above-mentioned non-gelatin binders is preferable. Depending on purposes, a lime-treated gelatin, acid-treated gelatin and delimed gelatin which has undergone a deliming process to decrease the content of calcium and the like can be used. Alternatively, a combination of these treated gelatin substances may be employed.

In the present invention, the coated weight of the binder is preferably 20 g/m$^2$ or less, and more preferably 1–20 g/m$^2$, and most preferably 2–10 g/m$^2$.

The coupler to be used in the present invention may be a 4-equivalent coupler or a 2-equivalent coupler. In these couplers, the nondiffusive group may form a polymeric chain. Details of the coupler are described, for example, in T. H. James, The Theory of the Photographic Process, 4th edition, pp. 291–334, pp. 354–361, and in Japanese Patent Application Laid-Open (JP-A) Nos. 58-123,533, 58-149,046, 58-149,047, 59-111,148, 59-124,399, 59-174,835, 59-231,539, 59-231,540, 60-2,950, 60-2,951, 60-14,242, 60-23,474, 60-66,249, 8-110,608, 8-146,552 and 8-146,578.

Further, the following couplers are preferably used in the present invention.

Yellow couplers: couplers represented by the formulas (I) and (II) in EP 502,242A; couplers represented by the formulas (1) and (2) in EP 513,496A; couplers represented by the general formula (I) described in claim 1 of Japanese Patent Application Laid-Open (JP-A) No. 5-307,248; couplers represented by the general formula (D) in U.S. Pat. No. 5,066,576, column 1, lines 45 to 55; couplers represented by the general formula (D) in Japanese Patent Application Laid-Open (JP-A) No. 4-274,425, paragraph 008; couplers described in EP 498,381A1, claim 1 on page 40; couplers represented by the formula (Y) in EP 447,969A1, pp. 4; and couplers represented by the general formulas (I) to (IV) in U.S. Pat. No. 4,476,219, column 7, lines 36 to 58.

Magenta couplers: couplers described in Japanese Patent Application Laid-Open (JP-A) Nos. 3-39,737, 6-43,611, 5-204,106 and 4-3,626.

Cyan couplers: couplers described in Japanese Patent Application Laid-Open (JP-A) Nos. 4-204,843 and 4-43,345.

Polymeric couplers: couplers described in Japanese Patent Application Laid-Open (JP-A) No. 2-44,345.

The couplers described in U.S. Pat. No. 4,366,237, GB 2,125,570, EP 96,570 and DE 3,234,533 are preferable as a coupler which generates a dye having an appropriate diffusive property.

In order to correct the unnecessary absorption of a coloring dye, the light-sensitive material in the present invention may contain a functional coupler, for example, the yellow colored cyan coupler and the yellow colored magenta coupler described in EP 456,257A1, the magenta colored cyan coupler described in U.S. Pat. No. 4,833,069 and the colorless masking coupler represented by the formula (2) in U.S. Pat. No. 4,837,136 and by the formula (A) in claim 1 of WO 92/11,575 (compounds shown at pages 36–45 in particular).

In the present invention, it is preferable to use a coupler or other compound which reacts with the oxidation product of a developing agent to release a photographically important compound.

Examples of the compounds (including couplers) which react with the oxidation product of a developing agent to release photographically important compound residues, include a compound which releases a development inhibitor such as compounds represented by the formulas (I) to (IV) described on page 11 in EP 378,236A1, compounds represented by the formula (I) described on page 7 in EP 436,938A2, compounds represented by the formula (1) described in Japanese Patent Application Laid-Open (JP-A) No. 5-307,248, compounds represented by the formulas (I) to (III) described on pages 5 and 6 in EP 440,195A2, compound-ligand releasing compounds represented by the formula (I) described in claim 1 of Japanese Patent Application Laid-Open (JP-A) No. 6-59,411 and compounds represented by LIG-X described in claim 1 of U.S. Pat. No. 4,555,478.

In the present invention, the amount of the coupler added is preferably from 1/1000 to 1 mol, and more preferably from 1/500 to 1/5 mol based on 1 mol of silver halide.

The light-sensitive material of the present invention should contain a developing agent, the oxidation product of which results from the silver development and is capable of coupling with the aforementioned coupler to form a dye.

Examples of such a combination of a coupler and a developing agent include a combination of p-phenylene diamines as a developing agent and a phenol or active methylene coupler described in U.S. Pat. No. 3,531,256 and a combination of p-aminophenols as a developing agent and an active methylene coupler described in U.S. Pat. No. 3,761,270.

Further, a sulfonamide phenol described in U.S. Pat. No. 4,021,240 and Japanese Patent Application Laid-Open (JP-A) No. 60-128,438, is preferable, because this combination assures an excellent storage stability of the raw light-sensitive material.

In the present invention, a precursor of a developing agent may be used, examples of which include an indoaniline compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane compound described in Japanese Patent Application Laid-Open (JP-A) No. 53-135,628.

Other combinations, i.e., a combination of a sulfonamide phenol developing agent and a coupler as described in Japanese Patent Application Laid-Open (JP-A) No. 9-15,806 and a combination of a hydrazine developing agent and a coupler as described in Japanese Patent Application Laid-Open (JP-A) Nos. 8-286,340 and 8-234,388, are also preferable for use in the light-sensitive material of the present invention.

In the present invention, it is preferable to use a compound, which is represented by one of the formulas (I), (II), (III) or (IV), as a developing agent.

Formula I

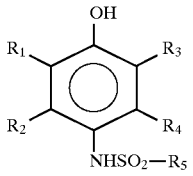

Formula II

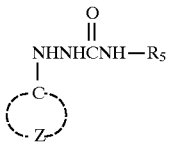

Formula III

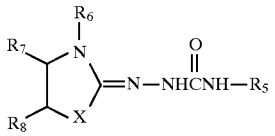

-continued

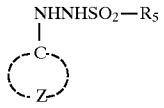

Formula IV

Details of these developing agents are described below.

The compounds represented by the formula (I) are generally called a sulfonamide phenol and are known compounds in the art. In these compounds, preferably at least one substituent selected from the substituents $R_1$ to $R_5$ has a ballast group having 8 or more carbon atoms in order to impart oil solubility to the compound.

In the formula (I), $R_1$ to $R_4$ each represent a hydrogen atom, a halogen atom (such as chlorine atom and bromine atom), an alkyl group (such as methyl, ethyl, isopropyl, n-butyl and t-butyl groups), an aryl group (such as phenyl, tolyl and xylyl groups), an alkylcarbonamide group (such as acetylamino, propionylamino and butyloylamino groups), an arylcarbonamide group (such as benzoylamino), an alkylsulfonamide group (such as methanesulfonylamino and ethanesulfonylamino groups), an arylsulfonamide group (such as benzenesulfonylamino and toluenesulfonylamino groups), an alkoxy group (such as methoxy, ethoxy and butoxy groups), an aryloxy group (such as phenoxy group), an alkylthio group (such as methylthio, ethylthio and butylthio groups), an arylthio group (such as phenylthio and tolylthio groups), an alkylcarbamoyl group (such as methylcarbamoyl, dimethylcarbamoyl, ethylcarbamoyl, diethylcarbamoyl, dibutylcarbamoyl, piperidylcarbamoyl and morpholylcarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl, piperidylsulfamoyl and morpholylsulfamoyl), an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonyl group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups), an arylcarbonyl group (such as benzoyl and alkylbenzoyl groups) or an acyloxy group (such as acetyloxy, propionyloxy and butyloyloxy groups). Among the $R_1$ to $R_4$ groups, $R_2$ and $R_4$ are each preferably a hydrogen atom. Further, the total of Hammett's constants $\sigma_p$ of $R_1$ to $R_4$ is preferably 0 or greater. $R_5$ represents an alkyl group (such as methyl, ethyl, butyl, octyl, lauryl, cetyl and stearyl groups), an aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl and 3,5-di-(methoxycarbonyl) groups) or a heterocyclic group (such as pyridyl group).

The compounds represented by the formula (II) are generally called a carbamoylhydrazine and are known compounds in the art. In these compounds, $R_5$ or a substituent linked to a ring preferably has a ballast group having 8 or more carbon atoms in order to impart oil solubility to the compound.

In the formula (II), Z represents a group of atoms forming an aromatic ring. The aromatic group indicated by Z should be sufficiently electron-attractive in order to make the compound silver development activity. From this standpoint, preferably employed is a heterocyclic ring, a nitrogen-containing aromatic ring in particular, or an aromatic ring such as a benzene ring having an electron-attractive substituent. In this sense, preferred aromatic rings include a pyridine ring, a pyradine ring, a pyrimidine ring, a quinoline ring and a quinoxaline ring. In the patrone of a benzene ring, examples of the substituents include a halogen atom (such as chlorine atom and bromine atom), an alkylcarbamoyl group (such as methylcarbamoyl, dimethylcarbamoyl, ethylcarbamoyl, diethylcarbamoyl, dibutylcarbamoyl, piperidylcarbamoyl and morpholynocarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl piperidylsulfamoyl and morpholinylsulfamoyl), an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonyl group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups) and an arylcarbonyl group (such as benzoyl and alkylbenzoyl groups). The total of Hammett's constant $\sigma$ of the above substituents is preferably 1 or greater.

The compounds represented by the formula (III) are generally called carbamoylhydrazones. The compounds represented by the formula (IV) are generally called sulfonylhydrazines. Both of these compounds are known compounds in the art. In these compounds, preferably at least one substituent selected from the substituents $R_5$ to $R_8$ has a ballast group having 8 or more carbon atoms in order to impart oil solubility to the compound.

In the formulas (III), $R_6$ represents an alkyl group (such as methyl or ethyl group). X represents an oxygen atom, a sulfur atom, a selenium atom or an alkyl- or aryl-substituted tertiary nitrogen atom. Preferably, X represents an alkyl-substituted tertiary nitrogen atom. $R_7$ and $R_8$ each represent a hydrogen atom or a substituent (examples of which include the above examples of substituents on benzene ring for Z). $R_7$ and $R_8$ may join each other to form a double bond or a ring.

Among the compounds represented by the formulas (I) to (IV), the compounds represented by the formulas I and (II) are preferable from the viewpoint of superior storage stability of the raw light-sensitive material.

In the above compounds, the substituents $R_1$ to $R_8$ may each have a substituent, examples of which include the above examples of substituents on the benzene ring Z.

Concrete examples of the compounds represented by the formulas (I) to (IV) are given below, but a developing agent used in the present invention are not limited to these examples.

D-1
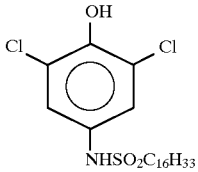
D-2
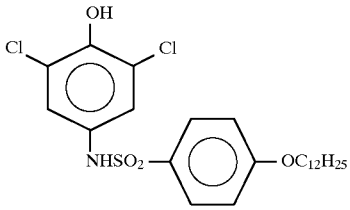
D-3
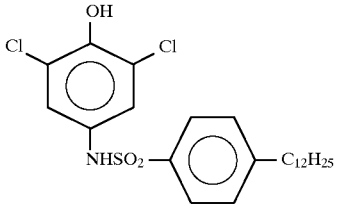
D-4
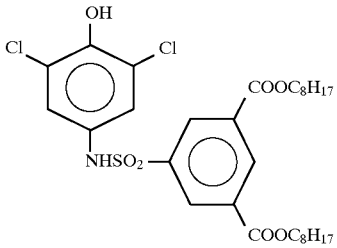
D-5
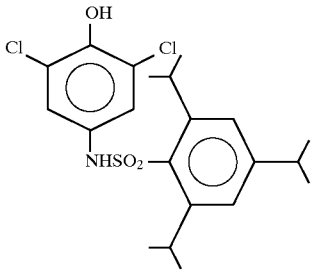
D-6
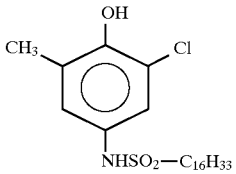
D-7
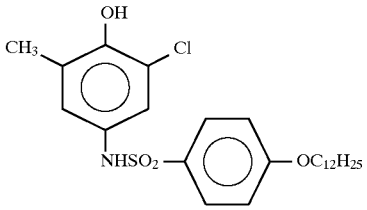

-continued
D-8
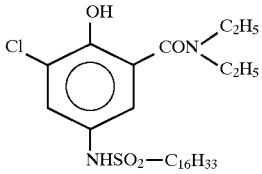
D-9
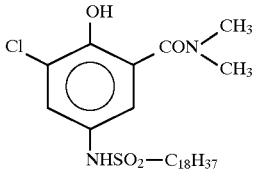
D-10
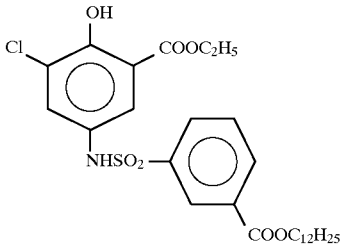
D-11
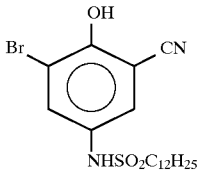
D-12
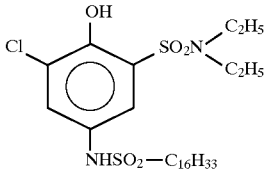
D-13
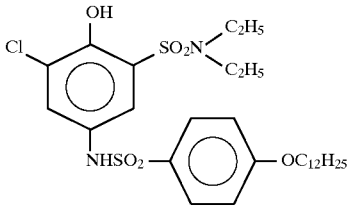
D-14
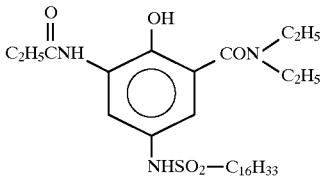
D-15
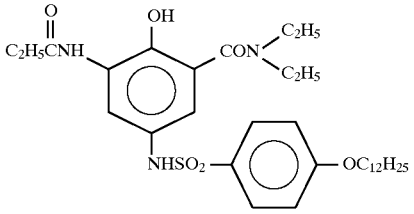

-continued
D-16
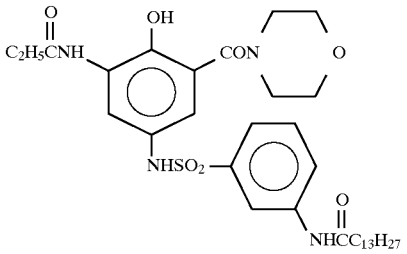
D-17
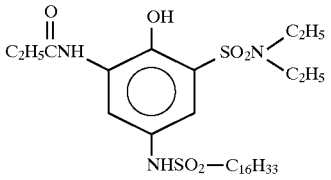
D-18
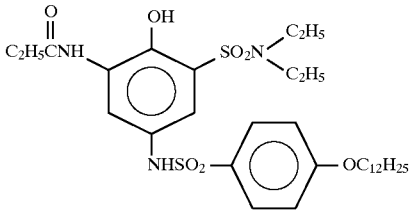
D-19
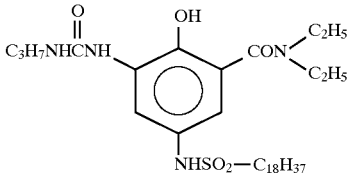
D-20
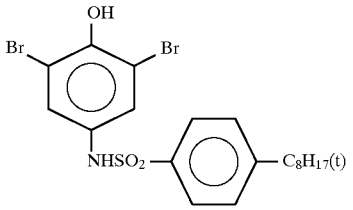
D-21
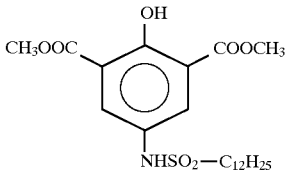
D-22
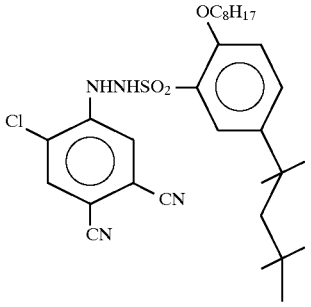

-continued
D-23
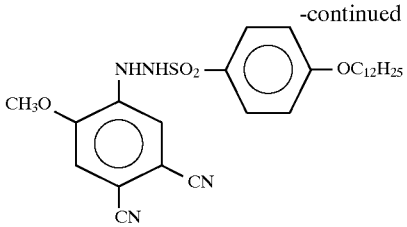
D-24
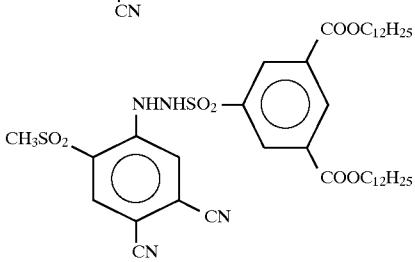
D-25
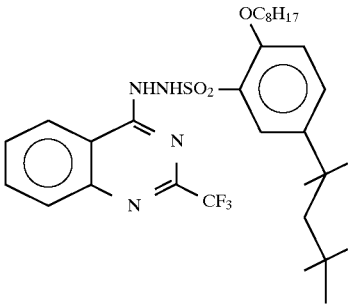
D-26
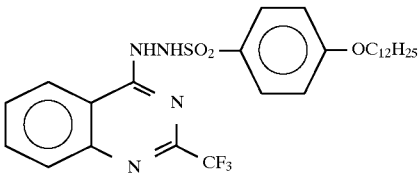
D-27
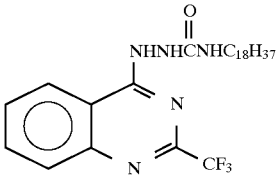
D-28
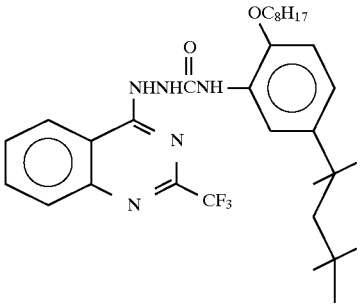
D-29
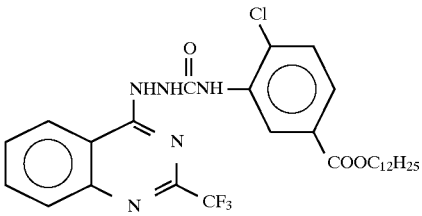

-continued
D-30
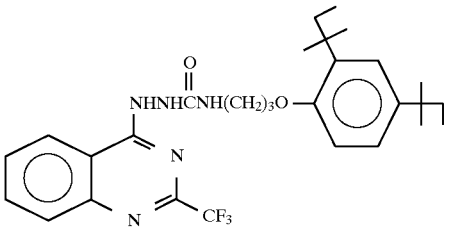
D-31
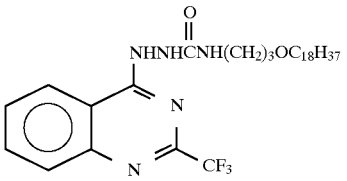
D-32
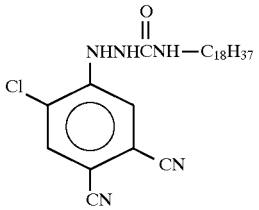
D-33
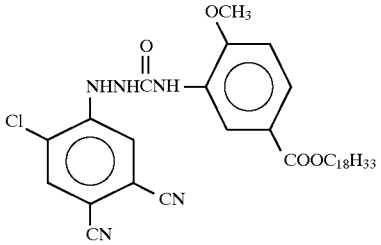
D-34
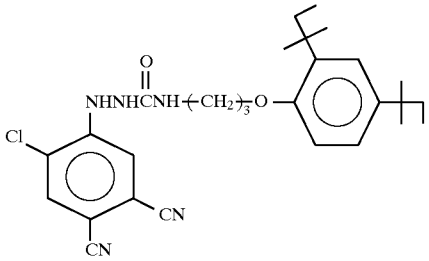
D-35
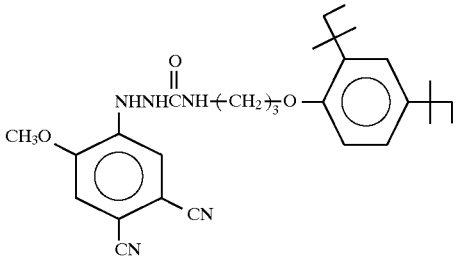

-continued
D-36
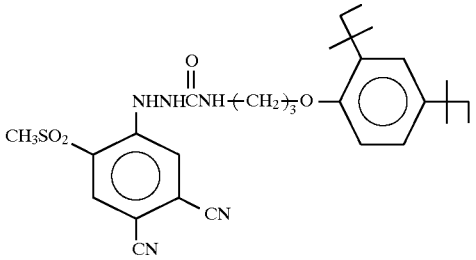
D-37
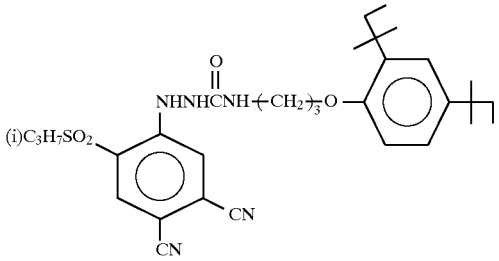
D-38
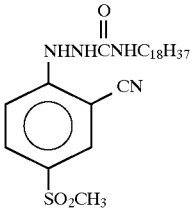
D-39
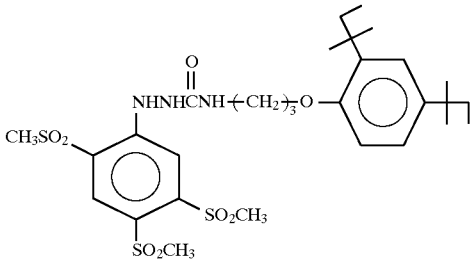
D-40
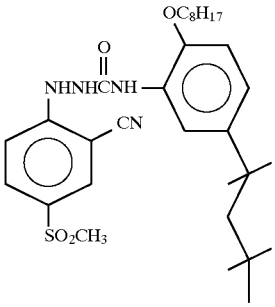
D-41
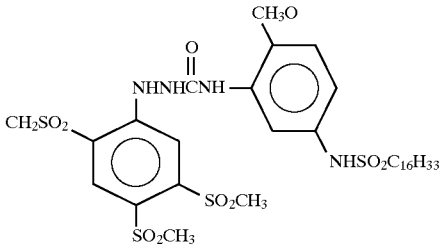

-continued
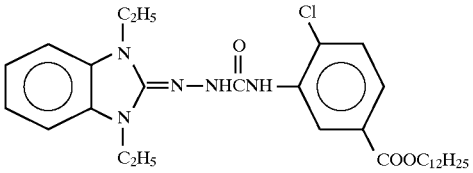
D-42
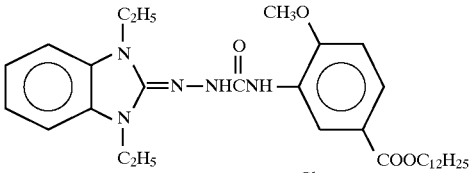
D-43
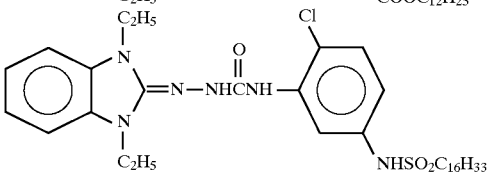
D-44
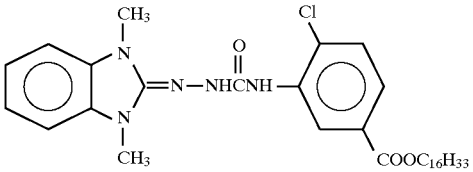
D-45
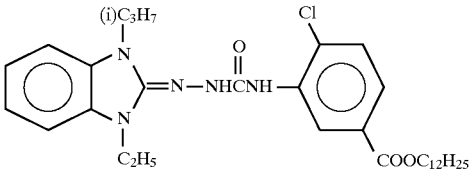
D-46
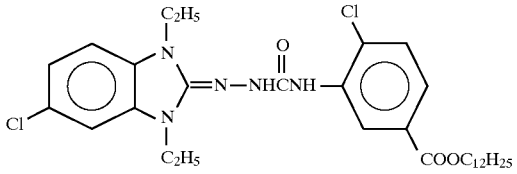
D-47
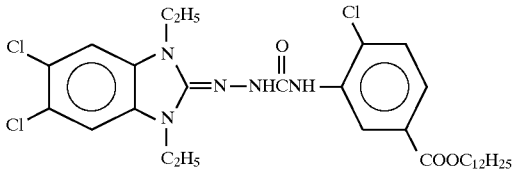
D-48
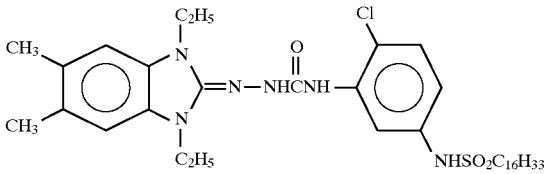
D-49
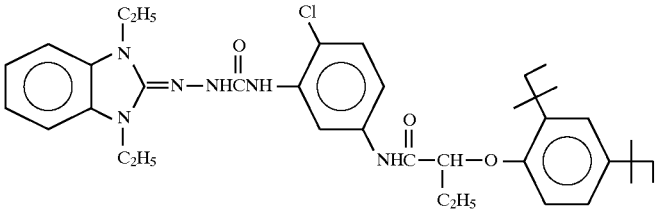
D-50

-continued
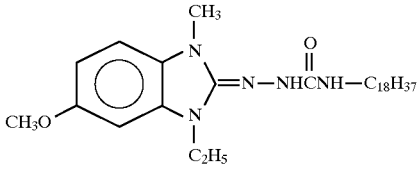
D-51
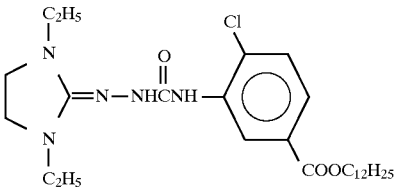
D-52
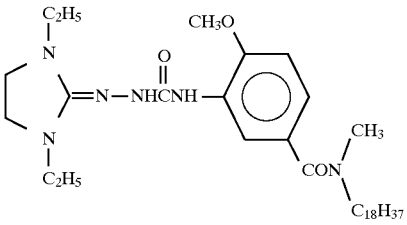
D-53
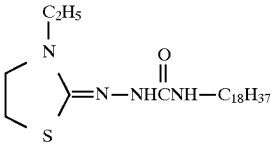
D-54
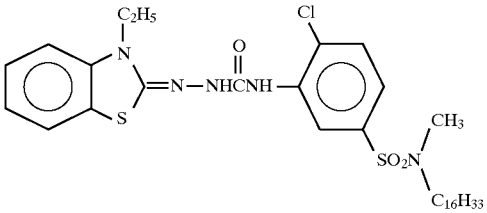
D-55
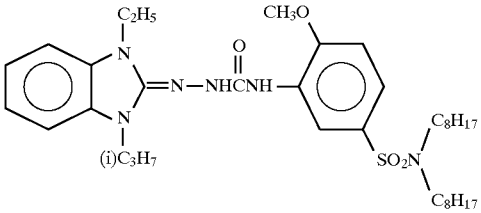
D-56
The above compounds can be synthesized by commonly known methods. Pathways for the syntheses are briefly described below.
Synthesis of Developing agent D-2
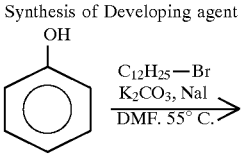
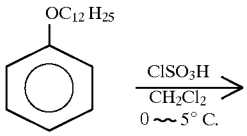
-continued
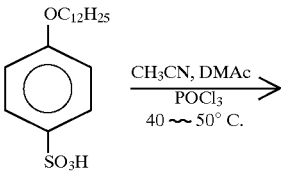

-continued

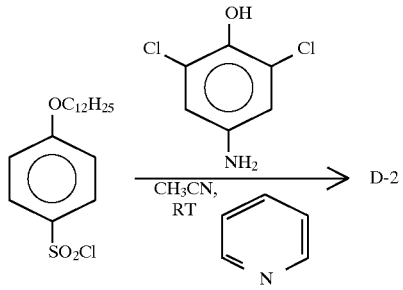

Synthesis of Developing agent D-27

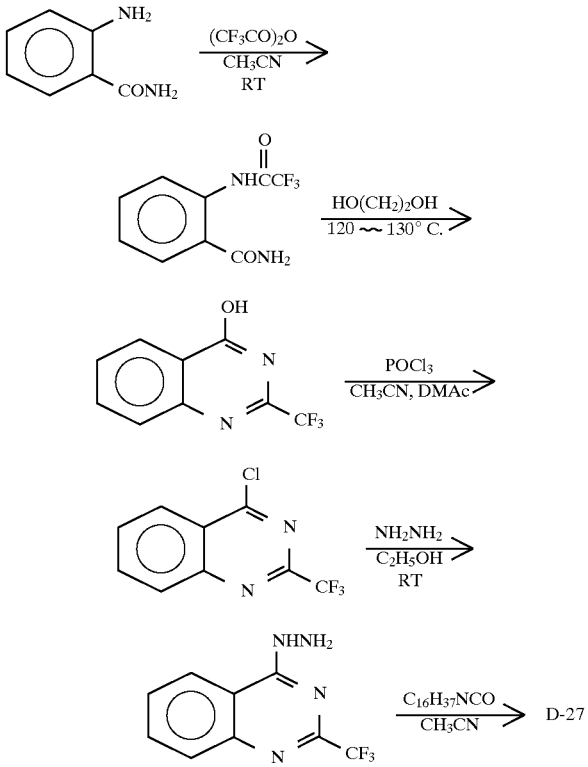

Synthesis of Developing agent D-42

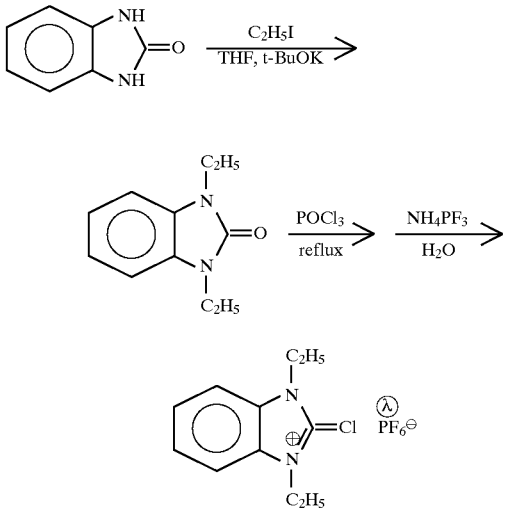

-continued

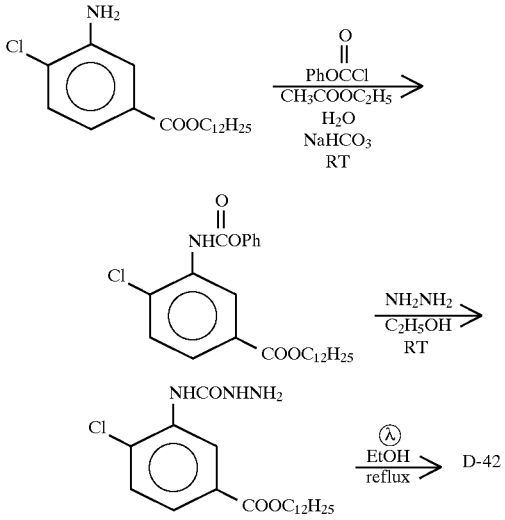

In the patrone where a nondiffusive developing agent is used, if necessary, an electron transport agent and/or a precursor thereof can be used in the light-sensitive material of the present invention in order to accelerate the transportation of electron between the nondiffusive developing agent and the silver halide which is to be developed. Use of electron transport agents and precursors thereof, which are described in U.S. Pat. No. 5,139,919 and in European Patent Application Laid-Open No. 418,743, is particularly preferred in the present invention. Use of methods for introducing the electron transport agent and/or precursor thereof into a layer in a stable manner, which are described in Japanese Patent Application Laid-Open (JP-A) Nos. 2-230, 143 and 2-235,044, is particularly preferred in the present invention.

An electron transport agent or a precursor thereof can be selected from the aforesaid developing agents or precursors thereof. The mobility of the electron transport agent or a precursor thereof is preferably greater than that of a nondiffusive developing agent (electron donor). A particularly useful electron transport agents are 1-phenyl-3-pyrazolidones or aminophenols.

A precursor of electron donor, which is described in Japanese Patent Application Laid-Open (JP-A) No. 3-160, 443, is also preferable for use in the light-sensitive material of the present invention.

For such purposes as prevention of color mixing, improvement in the color reproduction and the like, a reducing agent may be used in an intermediate layer or in a protective layer. The reducing agents, which are described in European Patent Application Laid-Open Nos. 524,649 and 357,040 and in Japanese Patent Application Laid-Open (JP-A) Nos. 4-249,245, 2-46,450 and 63-186,240, are particularly preferable for use in the present invention. Also usable are development inhibitor releasing reducers which are described in Japanese Patent Application Publication (JP-B) No. 3-63,733, Japanese Patent Application Laid-Open (JP-A) Nos. 1-150,135, 2-46,450, 2-64,634, and 3-43, 735 and European Patent Application Laid-Open No. 451, 833.

Further, a precursor of a developing agent, which does not have reducing properties per se but which exhibits reducing properties under the influence of a nucleophilic reagent or heat in the process of development, can be used in the light-sensitive material of the present invention.

The light-sensitive material of the present invention can contain any of the following reducing agents, examples of which are the reducing agents and precursors thereof described in U.S. Pat. Nos. 4,500,626, columns 49–50, 4,839,272, 4,330,617, 4,590,152, 5,017,454 and 5,139,919, Japanese Patent Application Laid-Open (JP-A) Nos. 60-140, 335, pp. 17–18, 57-40,245, 56-138,736, 59-178,458, 59-53, 831, 59-182,449, 59-182,450, 60-119,555, 60-128,436, 60-128,439, 60-198,540, 60-181,742, 61-259,253, 62-244, 044, 62-131,253, 62-131,256, 64-13,546, pp. 40–57, and 1-120,553 and European Patent Application Laid-Open No. 220,746A2, pp. 78–96.

Further, a combination of reducing agents, which is disclosed in U.S. Pat. No. 3,039,869, can also be used in the present invention.

The total amount of the developing agent and the reducing agent to be employed in the present invention is in the range of 0.1 to 20 mol, preferably 0.1 to 10 mol, based on 1 mol of silver.

In the present invention, either a 4-equivalent coupler or a 2-equivalent coupler is selected for use depending on the kind of the developing agent. Use of such a combination can prevent color mixing caused by movement of the oxidation product of a developing agent between adjacent layers. Examples of the 4-equivalent couplers and 2-equivalent couplers are described in detail in "Theory of the Photographic Process" (4th edition by T. H. James, Macmillan, 1977), pp. 291–334, pp. 354–361, and in Japanese Patent Application Laid-Open (JP-A) Nos. 58-12,353, 58-149,046, 58-149,047, 59-11,114, 59-124,399, 59-174,835, 59-231, 539, 59-231,540, 60-2,951, 60-14,242, 60-23,474 and 60-66,249 in addition to the aforementioned literature and patents.

Hydrophobic additives, such as a coupler, a developing agent and a nondiffusive reducing agent, can be introduced into a layer of a light-sensitive material according to a known method such as the method described in U.S. Pat. No. 2,322,027. In this patrone, an organic solvent having a high boiling point, which is described in U.S. Pat. Nos. 4,555, 470, 4,536,466, 4,536,467, 4,587,206, 4,555,476 and 5,599, 296 and in Japanese Patent Application Publication (JP-B) No. 3-62,256, can be used, if necessary, together with an organic solvent having a lower boiling point in the range of 50° to 160° C. Besides these color forming compounds, nondiffusive reducing agents, organic solvents having a high boiling point and the like may be used in a combination of two or more of them, respectively.

The amount of the organic solvent having a high boiling point is 10 g or less, preferably 5 g or less, more preferably in the range of 0.1 to 1 g, based on 1 g of the hydrophobic additives to be used. The amount of the organic solvent having a high boiling point is 1 cc or less, preferably 0.5 cc or less, more preferably 0.3 cc or less, based on 1 g of the binder.

Examples of useful methods for introducing a hydrophobic additive into the layer of a light-sensitive material include a dispersion method utilizing a polymer as described in Japanese Patent Application Publication (JP-B) No. 51-39,853 and Japanese Patent Application Laid-Open (JP-A) No. 51-59,943 and a method wherein a hydrophobic additive, which has been converted into a dispersion of fine grains, is added to the layer as described in Japanese Patent Application Laid-Open (JP-A) No. 62-30,242.

In addition to the above methods, in the patrone where the hydrophobic additive is a compound substantially insoluble in water, the hydrophobic compound may be dispersed in a binder.

When dispersing a hydrophobic compound to form a hydrophilic colloidal dispersion, a variety of surfactants can be used. For example, surfactants, which are described in Japanese Patent Application Laid-Open (JP-A) No. 59-157, 636, pp. 37–38, and in aforesaid Research Disclosure, can be used. In addition, a phosphoric ester-type surfactant, which is described in Japanese Patent Application Laid-Open (JP-A) Nos. 7-56,267 and 7-228,589 and in German Patent Application Laid-Open No. 1,932,299A, can also be used in the light-sensitive material of the present invention.

The light-sensitive material of the present invention may contain a compound which activates the development and stabilizes the image. Preferred examples of these compounds are described in U.S. Pat. No. 4,500,626, columns 51–52.

A non-light-sensitive layer, such as a protective layer, a substratum, an intermediate layer, a yellow filter layer and/or an antihalation layer, may be formed between the photographic light-sensitive layers containing silver halide emulsion of the light-sensitive material and/or as a top layer and/or a bottom layer thereof. Further, a supplementary layer, such as a back layer, may be formed on the reverse side of the substrate opposite to the side on which the photographic light-sensitive layer is formed. More specifically, it is possible to form, on the substrate, various layers including the above-mentioned construction, a substratum described in U.S. Pat. No. 5,051,335, an intermediate layer containing a solid pigment described in Japanese Patent Application Laid-Open (JP-A) Nos. 1-167,838 and 61-20,943, an intermediate layer containing a reducing agent or a DIR compound described in Japanese Patent Application Laid-Open (JP-A) Nos. 1-120,553, 5-34,884 and 2-64, 634, an intermediate layer containing an electron transport layer described in U.S. Pat. Nos. 5,017,454 and 5,139,919 and in Japanese Patent Application Laid-Open (JP-A) No. 2-235,044 and a protective layer containing a reducing agent described in Japanese Patent Application Laid-Open (JP-A) No. 4-249,245 as well as a combination of two or more of these layers.

A dye, which can be used in a yellow filter layer or in an antihalation layer, is preferably a dye which loses its color or is eliminated at the time of development so that it exerts no influence on the density of image after the process.

That the dye which is present in the yellow filter layer or in the antihalation layer loses its color or is eliminated at the time of development means that the amount of the dye remaining after the process is less than one third, preferably less than one tenth, of the amount of the dye present before the process. This may be attained by a phenomenon wherein the component of the dye is leached out of the light-sensitive material or is transferred into the processing material at the time of development, or by a phenomenon wherein the component of the dye undergoes a reaction and becomes a colorless compound at the time of development.

A known dye can be used in the light-sensitive material of the present invention. For example, employable dyes include a dye, which is soluble in an alkaline solution of a developer, and a dye which becomes colorless as a result of the reaction with an ingredient of the developing solution, sulfite ion, a developing agent or an alkali.

Concrete examples of the dyes include the dye described in European Patent Application EP 549,489A and the dye described in Japanese Patent Application Laid-Open (JP-A) No. 7-152,129, ExF 2–6. A dye which is dispersed in fine solid particles and is described in Japanese Patent Application Laid-Open (JP-A) No. 8-101,487 can also be used. Although this dye can also be used in the patrone where the light-sensitive material is developed with a processing solution, this dye is particularly suitable to the patrone where the light-sensitive material is subjected to a heat development utilizing a processing material which is described later.

Further, it is also possible to fix a dye to a mordant and a binder. In this patrone, the mordant and the dye may be those well known in the field of photography. Examples of the mordants include those described in U.S. Pat. No. 4,500,626, columns 58–59 and in Japanese Patent Application Laid-Open (JP-A) Nos. 61-88,256, pp. 32–41, 62-244,043 and 62-244,036.

Furthermore, it is also possible to use a reducing agent and a compound which reacts with the reducing agent to release a diffusive dye so that the alkali generated at the time of development causes the reaction to release a mobile dye, which will be eliminated either by being dissolved in the processing solution or by being transferred to the processing material. Examples of these compounds and reducing agents are described in U.S. Pat. Nos. 4,559,290 and 4,783,369, European Pat. No. 220,746A2, JIII Journal of Technical Disclosure No. 87-6,119 and Japanese Patent Application Laid-Open (JP-A) No. 8-101,487, paragraph 0080–0081.

A leuco dye, which becomes colorless, can also be used in the light-sensitive material of the present invention. For example, Japanese Patent Application Laid-Open (JP-A) No. 1-150,132 discloses a silver halide light-sensitive material containing a leuco dye which is given a color in advance by means of a metal salt of an organic acid as a color developer. Since a complex of a leuco dye and a developer undergoes a reaction by heat or reacts with an alkali to become colorless, the use of the combination of a leuco dye and a color developer in the light-sensitive material of the present invention is desirable if the light-sensitive material of the present invention is to be subjected to a heat development.

In the present invention, a known leuco dye can be used, examples of which are described in Moriga and Yoshida, "Senryo to Yakuhin (Dyes and Chemicals)," vol. 9, pp. 84, Association of Chemical Products, "Shinban Senryo Binran (New Handbook of Dyes)", pp. 242, Maruzen Co., Ltd. (1970), R. Garner, "Reports on the Progress of Applied Chemistry," vol. 56, pp. 199 (1971), "Senryo to Yakuhin (Dyes and Chemicals)", vol. 19, pp. 230, Association of Chemical Products (1974), "Shinkizai (Color Materials),", vol. 62, pp. 288 (1989) and "Senryo Kogyo (Die Industry)," vol. 32, pp. 208. Preferred color developers are a metal salt of an organic acid in addition to acid clay and a phenol/formaldehyde resin. Among metal salts of organic acids, metal salts of salicylic acids, a metal salt of a phenol/salicylic acid/formaldehyde resin, a rhodan salt and a metal salt of xanthogenic acid are preferable. Zinc is particularly preferable among the metals. An oil-soluble zinc salicylate described in U.S. Pat. Nos. 3,864,146 and 4,046,941 and in Japanese Patent Application Publication (JP-B) No. 52-1,327 can be also used as the color developers.

The light-sensitive material of the present invention is preferably hardened by means of a hardener.

Examples of the hardener include those described in U.S. Pat. Nos. 4,678,739, column 41 and 4,791,042, and in Japanese Patent Application Laid-Open (JP-A) Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis(vinylsulfonylacetamide) ethane), a N-methylol compound (e.g., dimethylolurea), boric acid, metaboric acid and a polymeric compound (e.g., a compound described in Japanese Patent Application Laid-Open (JP-A) No. 62-234,157).

The amount of the hardener added is in the range of 0.001 g to 1 g, preferably 0.005 to 0.5 g, based on 1 g of the hydrophilic binder.

The light-sensitive material may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, Japanese Patent Application Laid-Open (JP-A) No. 64-13,564, pp. 7–9, pp. 57–71 and pp. 81–97, U.S. Pat. Nos. 4,775,610, 4,626,500 and 4,983,494, Japanese Patent Application Laid-Open (JP-A) Nos. 62-174,747, 62-239,148, 1-150,135, 2-110,557, 2-178,650 and RD 17,643 (1978) pp. 24–25.

The amount of these compounds added is preferably in the range of $5\times10^{-6}$ to $1\times10^{-1}$ mol, more preferably $1\times10^{-5}$ to $1\times10^{-2}$ mol, based on 1 mol of silver.

As a method of developing the light-sensitive material of the present invention after exposure, a heat development and activator method using alkaline processing solution may be used.

It may also be possible to form an image by processing the light-sensitive material of the present invention with a processing solution containing a developing agent and base.

A thermal process of a light-sensitive material is well known in the art. For example, a light-sensitive material for heat development and a heat development process are described in "Syashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32 - pp. 33, U.S. Pat. Nos. 3,152,904, 3,301,678, 3,392,020 and 3,457,075, U. K. Pat. Nos. 1,131,108 and 1,167,777 and Research Disclosure (June, 1978), pp. 9–15 (RD-17,029).

An activator process means a developing process in which a light-sensitive material containing a color developing agent is treated with a processing solution containing no color developing agent. A feature of the activator process is that the processing solution for the process does not contain a color developing agent which is contained in an ordinary developing solution. The processing solution for the activator process may contain components, such as an alkali and a co-developing agent. Examples of the activator processes are described in publicized literatures such as European Patent Nos. 545,491A1 and 565,165A1.

Methods for developing a light-sensitive material by means of a processing solution containing a developing agent and a base are described in RD Nos. 17,643, pp. 28–29, 18,716, pp. 651, left column to right column, and 307,105, pp. 880–881.

Details of the processing material and processing method to be employed in the hot developing process in the present invention are given below.

The light-sensitive material of the present invention preferably contains a base or a base precursor in order to accelerate the development of silver and the dye forming reaction. Examples of the base precursor include a salt of an organic acid and a base capable of decarboxylation by means of heat and a compound capable of releasing an amine by means of an intramolecular neucleophilic substitution reaction, a Lossen rearrangement or a Beckmann rearrangement. Examples of these compounds are described in U.S. Pat. Nos. 4,514,493 and 4,657,848 as well as in "Known Technologies" No. 5 (issued on Mar. 22, 1991, AZTEC Co., Ltd.), pp. 55–86. In addition, a combination of a sparingly water-soluble basic metal compound and a compound capable of reacting with the metal contained in the foregoing basic metal compound by use of water as a medium to form a complex compound (hereinafter referred to as a complex forming compound) can also be used in the present invention, as described in and European Patent Application Laid-Open No. 210,660 and in U.S. Pat. No. 4,740,445.

The amount of the base or the base precursor to be used in the present invention is in the range of 0.1 to 20 g/m$^2$, preferably 1 to 10 g/m$^2$.

The light-sensitive material of the present invention may contain a thermal solvent, examples of which include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in Japanese Patent Application Publication (JP-B) Nos. 1-40,974 and 4-13,701), polyol compounds (e.g., a sorbitol and a polyethylene glycol).

Where the thermal solvent is insoluble in water, preferably the thermal solvent is used as a solid dispersion. Depending on the purposes, the thermal solvent may be contained in any of a light-sensitive layer and non-light-sensitive layer.

The amount of the thermal solvent added is in the range of 10 to 500% by weight, preferably 20 to 300% by weight, based on the weight of the binder present in the layer to which the thermal solvent is to be added.

Although the heating temperature of the heat development process is in the range of about 50° to 250° C., the temperature is preferably in the range of 60° to 150° C., more preferably in the range of 70° to 100° C. The heating duration is preferably 5 to 60 seconds.

In order to supply a base, which is needed for the heat development process, to the light-sensitive material of the present invention, a processing material is used which has a processing layer containing a base or a base precursor. The processing material may have other functions, for example, a function to shut out the air at the time of heat development, a function to prevent the vaporization of the components of the light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The substrate and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in Japanese Patent Application Laid-Open (JP-A) No. 61-88, 256, pp. 32- 41, 62-244,043 and 62-244,036. Further, the processing material can contain a dye acceptor polymeric compound described in U.S. Pat. No. 4,463,079, or the above-mentioned thermal solvent.

The processing layer of the processing material contains a base and/or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

At the time when the light-sensitive material of the present invention undergoes the hot developing process utilizing the processing material, a small amount of water is used for such purposes as acceleration of development, acceleration of the transfer of the processing material, or acceleration of the diffusion of unnecessary substances as described in U.S. Pat. Nos. 4,704,245 and 4,470,445 and in Japanese Patent Application Laid-Open (JP-A) No. 61-238, 056. Such compounds as an inorganic salt of an alkali metal, an organic base, a solvent having a low boiling point, a surfactant, an anti-fogging agent, a compound forming a complex with a sparingly water-soluble metal salt, an anti-mold agent and an antibacterial agent may be added to the water.

The water is not particularly specified, and examples of the water include ion exchange water, distilled water, tap water, well water and mineral water. In the hot developing apparatus utilizing the light-sensitive material of the present invention and the processing material, the waste water may be discarded without being reused or may be recycled for repeated use. When using recycled water, the water used accumulates the components leached out of the materials over repeated use. Further, the apparatus and water described in Japanese Patent Application Laid-Open (JP-A) Nos. 63-144,354, 63-144,355, 62-38,460 and 3-210,555 may be used in the present invention.

Water can be supplied to the light-sensitive material or to the processing material or to both of them. The amount of the water to be added ranges preferably from 1/10 to the equivalent of an amount which is required for the maximum swelling of the entire coating layers (not including the back layer) composed of the light-sensitive material and the processing material.

Preferred examples of methods for supplying water to these materials include the methods described in Japanese Patent Application Laid-Open (JP-A) Nos. 62-253,159, pp. 5, and 63-85,544. Further, water in the form of microcapsules or hydrates may be incorporated in advance into the light-sensitive material or the processing material or into both of them.

The temperature of the water to be supplied may be in the range of 30° to 60° C. as described, for example, in Japanese Patent Application Laid-Open (JP-A) No. 63-85,544.

When conducting a heat development of the light-sensitive material in the presence of a small amount of water, it is effective to adopt a method in which a combination of a sparingly water-soluble basic metal compound and a complex forming compound so that a base is generated, as described in and European Patent Application Laid-Open No. 210,660 and in U.S. Pat. No. 4,740,445. In this patrone, it is desirable to incorporate the sparingly water-soluble basic metal compound in the light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for placing the light-sensitive material and the processing material face to face so that the light-sensitive layer and the processing layer face each other, the methods, which are described in Japanese Patent Application Laid-Open (JP-A) Nos. 62-253,159 and 61-147,244, pp. 27, can be employed.

For the purpose of processing the light-sensitive material and the processing material of the present invention, any known apparatus for heat development can be used. Preferred examples of the apparatus include the apparatus described in Japanese Patent Application Laid-Open (JP-A)

Nos. 59-75,247, 59-177,547, 59-181,353 and 60-18,951, Japanese Utility Model Application Laid-Open (JP-U) No. 62-25,944 and Japanese Patent Application Laid-Open (JP-A) Nos. 6-130,509, 6-95,338, 6-95,267, 8-29,955, and 8-29,954.

In addition, commercially available apparatus such as "Pictrostat" 100, 200, 300, 330 and 50 and "Pictrography" 3000 and 2000, manufactured by Fuji Photo Film Co., Ltd. Can be used in the present invention.

The light-sensitive material and/or the processing material of the present invention may have an electroconductive heat generator layer as a heating means for the heat development. For example, a heat generator layer described in Japanese Patent Application Laid-Open (JP-A) No. 61-145,544 can be used.

In the present invention, although the image information can be read out without removing the silver produced by development, and undeveloped silver halide from the light-sensitive material, it can be read out after removing the silver or silver halide. In the latter patrone, the silver or silver halide can be removed concurrently with or after the development.

In order to remove the developed silver from the light-sensitive material concurrently with the development or in order to complex or solubilize the silver halide, the processing material may contain a silver oxidizing or re-halogenating agent, which serves as a bleaching agent, and a solvent for the silver halide, which serves as a fixing agent, so that these reactions occur at the time of the heat development.

Further, after the developing process, a second processing material which contains a silver oxidizing or re-halogenating agent or a solvent for the silver halide and the light-sensitive material may be placed face to face in order that the removal of the developed silver or the complexing or solubilizing of the silver halide be carried out.

In the present invention, in so far as the above-mentioned process does not provide adverse effects on the reading out of image information after development, it is preferable that the light-sensitive material be subjected to the above-mentioned process. Since the undeveloped silver halide causes significant haze in gelatin film to an extent that the background density increases, it is preferable to diminish the haze by use of the above-mentioned complexing agent or to solubilize the silver halide so that all or part of the silver halide is removed from the film.

From the viewpoint of reducing haze, it is preferable to use tabular silver halide grains having high aspect ratio or tabular silver halide grains containing silver chloride in high content, as described in the present invention.

In the present invention, a processing material can comprise a commonly used silver bleaching agent. Examples of a silver bleaching agent are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid. The fixing agent can be a solvent for silver halide (i.e., solvent capable of dissolving silver halide) which can be used in the processing material for developing the light-sensitive material (the first processing material). The binder, substrate and other additives usable in the second processing material can also be the same substances as those usable in the first processing material.

The amount of bleaching agent to be added should be determined depending on the amount of silver contained in the light-sensitive material, and is in the range of 0.01 to 10 times, preferably 0.1 to 3 times, and more preferably 0.1 to 2 times the amount (mol) of silver present in the light-sensitive material per unit area.

The solvent for silver halide may be a known compound, examples of which include thiosulfates, such as sodium thiosulfate and ammonium thiosulfate, sulfites, such as sodium sulfite and sodium hydrogen sulfite, thiocyanates, such as potassium thiocyanate and ammonium thiocyanate, thioethers, such as 1,8-di-3,6-dithiaoctane, 2,2'-thiodiethanol, 6,9-dioxa-3,12-dithiatetradecane-1,14-diol as described in Japanese Patent Application Publication (JP-B) No. 47-11,386, a compound having a 5- or 6-membered imido ring, such as urasil and hydantoin as described in Japanese Patent Application Laid-Open (JP-A) No. 8-179,458, and a compound represented by the following general formula (V) as described in Japanese Patent Application Laid-Open (JP-A) No. 53-144,319. A mesoion thiolate compound of trimethyltriazolium thiolate described in "Analytica Chemica Acta", vol. 248, pp. 604 to 614 (1991), is also a preferred compound. A compound which is described in Japanese Patent Application Laid-Open (JP-A) No. 8-69,097 and which is capable of fixing a silver halide to stabilize it can also be used as a solvent for the silver halide. General formula (V)

$$N(R^9)(R^{10})-C(=S)-Y-R^{11}$$

where Y represents a sulfur atom or an oxygen atom. $R^9$ and $R^{10}$, which may be the same or different, each represent an aliphatic group, an aryl group, a heterocyclic group or an amino group. $R^{11}$ represents an aliphatic group or an aryl group. $R^9$ and $R^{10}$ or $R^{10}$ and $R^{11}$ may join together to form a 5-membered or a 6-membered heterocyclic ring. The above-described solvents for the silver halide may be used alone or in a combination of two or more of them.

Among the above-described compounds, a compound having a 5-membered or 6-membered imido ring, such as urasil or hydantoin, is particularly preferable. The addition of urasil or hydantoin in the form of potassium salt is preferable, because the salt can suppress gloss reduction during the storage of the processing material.

The content of the total amount of the solvent for silver halide in the processing layer is in the range of 0.01 to 100 mmol/$m^2$, preferably 0.1 to 50 mmol/$m^2$, and more preferably 10 to 50 mmol/$m^2$. The total amount of the solvent for the silver halide in the light-sensitive material is in the range of 1/20 to 20 times, preferably 1/10 to 10 times, and more preferably 1/3 to 3 times the amount (mol) of silver present in the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halide may be added to a coating solution.

Alternatively, the processing material may contain a physical development nucleus and the solvent for silver halide, so that the solvent for silver halide solubilizes the silver halide contained in the light-sensitive material concurrently with the development and so that the physical development nucleus reduces the soluble silver halide diffused from the light-sensitive material to convert it to physically developed silver which is to be fixed to a processing layer. Any physical development nucleus known as such can be used in the present invention. Examples of the physical development nucleus include colloidal grains of a heavy metal, such as zinc, mercury, lead, cadmium, iron, chromium, nickel, tin, cobalt, copper, and ruthenium, a precious metal, such as palladium, platinum, silver, and gold, a chalcogen compound composed of the foregoing and a substance such as sulfuric acid, selenium or tellurium. These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/M2, preferably from $10^{-2}$ to 10 mg/m$^2$, in the processing layer.

Although the physical development nucleus may be prepared separately from a coating solution and thereafter the physical development nuclei may be added to the coating solution, the physical development nucleus may be prepared, for example, by the reaction between silver nitrate and sodium sulfide or between gold chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have low fogging and high Dmax (maximum density) values.

Both the first processing material and the second processing material can have at least one polymerizable timing layer. The polymerizable timing layer can temporarily retard the bleaching and fixing reaction until the desired reaction among the silver halide, a dye forming compound and a developing agent substantially ends. The timing layer may comprise gelatin, polyvinyl alcohol or a vinyl alcohol/vinyl acetate copolymer. This layer may be a barrier timing layer as described in U.S. Pat. Nos. 4,056,394, 4,061,496 and 4,229,516.

The film thickness of the timing layer is in the range of 5 to 50 $\mu$m, preferably 10 to 30 $\mu$m.

According to the present invention, the light-sensitive material after exposure thereof is bleached and fixed utilizing the second processing material. That is, the process comprises supplying water, in an amount ranging from 1/10 to the equivalent of an amount which is required for the maximum swelling of the total of the light-sensitive material layer and the second processing material layer excepting the back respective layers, to the light-sensitive material or to the second processing material, placing the light-sensitive material and the second processing material so that the light-sensitive layer and processing layer face each other and thereafter heating them to a temperature in the range of 40° to 100° C. for 5 to 60 seconds.

As for the amount of water, kind of water, method of supplying water and method of placing the light-sensitive material and the second processing material face to face, the same as those in the patrone of the first processing material can be employed.

More specifically, the second processing material described in Japanese Patent Application Laid-Open (JP-A) No. 59-136,733, U.S. Pat. No. 4,124,398 and Japanese Patent Application Laid-Open (JP-A) No. 55-28,098 can be used in the present invention.

For such purposes as improvement of the coatability, improvement of the releasability, improvement of the slipperiness, prevention of electrostatic charge and acceleration of developing reaction, a surfactant may be added to the light-sensitive material. Examples of the surfactants include those described in "Known Technologies" No. 5 (issued on Mar. 22, 1991, AZTEC Co., Ltd.), pp. 136–138 and in Japanese Patent Application Laid-Open (JP-A) Nos. 62-173,463 and 62-183,457.

For such purposes as prevention of slip, prevention of electrostatic charge and improvement of the releasability, an organic fluorine-containing compound may be added to the light-sensitive material. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in Japanese Patent Application Publication (JP-B) No. 57-9,053, columns 8–17, Japanese Patent Application Laid-Open (JP-A) Nos. 61-20,944 and 62-135,826.

Preferably, the light-sensitive material has a certain level of slipperiness. For this purpose, the light-sensitive material may contain a slicking agent. It is preferable that a slicking agent is contained both in the light-sensitive layer and in the back layer. A preferred level of slipperiness is indicated by a coefficient of dynamic friction in the range of 0.01 to 0.25, which represents a measured value determined in a test comprising sliding the light-sensitive material at a rate of 60 cm/minute against stainless steel balls having a diameter of 5 mm (25° C., 60% RH).

Examples of usable slicking agents include polyorganosiloxanes, higher aliphatic acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. Polydimethylsiloxane and an ester having a long alkyl chain are particularly preferable. The layer to which the slicking agent is added is preferably the outermost light-sensitive layer or the back layer.

It is preferable to use an anti-static agent in the present invention. Polymers, which contain carboxylic acid, carboxylic acid salt or a sulfonic acid salt, cationic polymers and ionic surfactants can be used as the anti-static agent.

The most preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ Ω·cm or less, preferably $10^5$ Ω·cm or less, or grains of a complex oxide thereof, for example, complex of an element such as Sb, P, B, In, S, Si, C and the like and the foregoing metal oxide. The amount of an anti-static agent present in the light-sensitive material is preferably in the range of 5 to 500 $mg/m^2$, more preferably in the range of 10 to 350 $mg/m^2$. The ratio of the electroconductive crystalline oxide or the complex oxide thereof to a binder is preferably in the range of 1/300 to 100/1, more preferably 1/100 to 100/5.

Constituent layers (including back layers) of the light-sensitive material or processing material can contain a polymer latex in order to improve film physical properties such as dimension stability, prevention of curling, prevention of adhering, prevention of film cracking and prevention of pressure-induced sensitization or desensitization. Any and all polymer latices, which are described in Japanese Patent Application Laid-Open (JP-A) Nos. 62-245,258, 62-136,648 and 62-110,066, can be used in the present invention. Particularly, the utilization of a polymer latex having a low glass transition point (40° C. or less) in the mordant layer of the processing material can prevent cracking of the mordant layer, while the utilization of a polymer latex having a high glass transition point in the back layer of the processing material can prevent curling.

Preferably, the light-sensitive material of the present invention contains a matting agent. Although the matting agent may be added to either the light-sensitive layer or the back layer, it is particularly preferable that the matting agent be added to the outermost layer on the same side of the substrate as the light-sensitive layer is provided. Although the matting agent may be soluble or insoluble in a processing solution, it is preferable to use a combination of a soluble matting agent and an insoluble matting agent in the present invention. An example of such a combination of matting agents comprises grains of polymethyl methacrylate, poly (methyl methacrylate/methacrylic acid) (in a molar ratio of 9/1 or 5/5) and polystyrene. The matting agent has grain diameters preferably in the range of 0.8 to 10 $\mu$m and preferably has a narrow range of grain diameter distribution. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 $\mu$m or less, together with the matting agent having the above-mentioned grain diameter. Examples of fine grains include grains of polymethyl methacrylate (0.2 $\mu$m), grains of poly(methyl methacrylate/methacrylic acid) (in a molar ratio of 9/1, 0.3 $\mu$m ), grains of polystyrene (0.25 $\mu$m) and grains of colloidal silica (0.03 $\mu$m).

Concrete examples of the matting agent are described in Japanese Patent Application Laid-Open (JP-A) No. 61-88, 256, pp. 29. Other examples of the matting agent are such materials as benzoguanamine resin beads, polycarbonate beads and AS resin beads, all of which are described in Japanese Patent Application Laid-Open (JP-A) Nos. 63-274, 944 and 63-274,952. Further, the compounds which are described in the aforesaid Research Disclosure can be employed as the matting agent.

In the present invention, a substrate for the light-sensitive material and the processing material needs to be able to withstand the processing temperature. Generally, examples of the substrate are paper, a synthetic polymer (film) and the like, as described in "Syashinkogaku no kiso —Ginen Syashin Hen (Fundamentals of Photographic Engineering—Silver Salt Photography Section)", pp. 223–240, edited by Photographic Society of Japan, Corona Co., Ltd., 1979. Concrete examples of the substrate include polyethylene terephthalate, polyethylene naphthalate, polycarbonate, polyvinyl chloride, polystyrene, polypropylene, polyimide and cellulose (e.g., triacetylcellulose).

These materials may be used alone. Further, a substrate in which a synthetic polymer such as polyethylene may be laminated to one side or both sides of paper can be used.

Other substrates, which can be used in the present invention, include those described in Japanese Patent Application Laid-Open (JP-A) Nos. 62-253,159, pp. 29–31, 1-161,236, pp. 14–17, 63-316,848, 2-22,651 and 3-56,955 and U.S. Pat. No. 5,001,033.

Where requirements of resistance to heat and curling are stringent, preferred examples of the substrates are those described in Japanese Patent Application Laid-Open (JP-A) Nos. 6-41,281, 6-43,581, 6-51,426, 6-51,437 and 6-51,442 and in Japanese Patent Application Laid-Open (JP-A) Nos. 6-82,961, 6-82,960, 6-123,937, 6-82,959, 6-67,346, 6-266, 050, 6-202,277, 6-175,282, 6-118,561, 7-219,129 and 7-219,144 and U.S. Pat. No. 5,326,689.

Also preferable is a substrate mainly made from a styrene-based polymer having a syndiotactic structure.

In order to bond the photographic layer to the substrate, it is preferable that the substrate be surface-treated. Examples of the surface processes include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are particularly preferable.

A substratum may comprise single layer or may comprise two or more layers. Examples of the binder for the substratum include a copolymer, which is made up of a monomer selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the substrate, include resorcin and p-chlorophenol. Examples of a gelatin-hardening agent which can be used in the substratum include chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the substratum may contain $SiO_2$, $TiO_2$, grains of an inorganic material or grains of a copolymer of polymethyl methacrylate (0.01 to 10 $\mu$m) as a matting agent.

In addition, it is preferable to record photographic information and the like by use of a substrate which is provided with a magnetic recording layer and is described in Japanese Patent Application Laid-Open (JP-A) Nos. 4-124,645, 5-40, 321, 6-35,092 and 6-317,875.

A magnetic recording layer is formed by coating onto a substrate an aqueous or organic solvent-based coating solution comprising a binder and magnetic grains dispersed therein.

Examples of usable magnetic grains include ferromagnetic iron oxide such as $\gamma$-$Fe_2O_3$, Co-covered $\gamma$-$Fe_2O_3$, Co-covered magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-covered ferromagnetic iron oxide such as Co-covered $\gamma$-$Fe_2O_3$ is preferable. The shape of the magnetic grains may be selected from the group consisting of needles, grains, spheres, cubes and plates. The specific surface area in $S_{BET}$ is preferably 20 $m^2/g$ or greater, more preferably 30 $m^2/g$ or greater. The saturation magnetization (σs) of the ferromagnetics is preferably in the range of $3.0\times10^4$ to $3.0\times10^5$ A/m, more preferably $4.0\times10^4$ to $2.5\times10^5$ A/m. The ferromagnetic grains may be surface-treated with silica and/or alumina or with an organic substance. Further, as described in Japanese Patent Application Laid-Open (JP-A) No. 6-161,032, the ferromagnetic grains may be surface-treated with a silane coupling agent or with a titanium coupling agent. Magnetic grains, which are covered with an inorganic or organic substance and are described in Japanese Patent Application Laid-Open (JP-A) Nos. 4-259,911 and 5-81,652, can also be used in the present invention.

As described in Japanese Patent Application Laid-Open (JP-A) No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40° to 300° C. and a weight-average molecular weight in the range of 2,000 to 1,000,000. Preferred examples of the binder include vinyl-based copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di(tri)acetate is particularly preferable. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in Japanese Patent Application Laid-Open (JP-A) No. 6-59,357.

As described in Japanese Patent Application Laid-Open (JP-A) No. 6-35,092, the aforementioned magnetic grains are dispersed in a binder preferably by means of a kneader, a pin-type mill or an annular mill. A combination of these dispersing means is also preferable. A dispersant, such as the dispersant described in Japanese Patent Application Laid-Open (JP-A) No. 5-88,283 and other known dispersants, may be used in order to disperse the magnetic grains in the binder. The thickness of the magnetic recording layer is in the range of 0.1 to 10 μm, preferably 0.2 to 5 μm, and more preferably 0.3 to 3 μm. The ratio of the weight of the magnetic grains to the weight of the binder is preferably in the range of 0.5:100 to 60:100, more preferably 1:100 to 30:100. The coated weight of the magnetic grains is in the range of 0.005 to 3 g/m$^2$, preferably 0.01 to 2 g/m$^2$, and more preferably 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic substrate by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in Japanese Patent Application Laid-Open (JP-A) No. 5-341,436, is preferably used.

The magnetic recording layer may also function in the enhancement of lubrication, control of curling, prevention of electrostatic charge, prevention of adhering and head polishing. Also, another functional layer having any of these functions may be formed. The abrasive grains, which impart a head polishing function to the magnetic recording layer or to another functional layer, preferably contain at least one type of grain having a Moh's hardness of 5 or greater and are non-spherically shaped inorganic grains. Examples of non-spherical inorganic grains include oxides, such as aluminum oxide, chromium oxide, silicon dioxide and titanium dioxide, carbides, such as silicon carbide and titanium carbide, and diamond. The surface of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and 5,215,874 and in EP 466,130.

A polyester substrate, which is preferably used in the light-sensitive material having the above-described magnetic recording layer, is described below. Details of the polyester substrate along with a light-sensitive material, a processing procedure, a cartridge and examples in use thereof are shown in JIII Journal of Technical Disclosure No. 94-6,023 (issued on Mar. 15, 1994 from The Japan Institution of Invention and Innovation).

The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers, which are formed from theses monomers, include homopolymers such as polyethylene terephthalate, polyethylene naphthalate and polycyclohexanedimethanol terephthalate. A polyester, in which 2,6-naphthalenedicarboxylic acid comprises 50 to 100 mol % of the carboxylic acid monomer composition, is preferable, and polyethylene 2,6-naphthalate is particularly preferable. The average molecular weight of the polyester is in the range of about 5,000 to 200,000. Tg of the polyester is 50° C. or greater, preferably 90° C. or greater.

Next, in order to make the polyester substrate low-curling, the polyester substrate is subjected to a heat process at a temperature which is preferably above 40° C. but below Tg, more preferably above (Tg-20) °C. but below Tg. The heat process may be carried out in a continuous manner at a temperature within the above-mentioned range, or it may be carried out discontinuously so that a cooling step is effected between heat-processing steps. The duration of the heat process is preferably in the range of 0.1 to 1,500 hours, more preferably 0.5 to 200 hours. The heat process may be effected while the substrate is held in the shape of a roll, or the heat process may be effected while the substrate is in the shape of a web while being carried. Electroconductive inorganic grains, such as $SnO_2$ and $Sb_2O_5$, may be provided onto the surface of the substrate to impart surface roughness so that the surface condition is improved. Further, it is preferable that the substrate be designed in such a way that the tips of the roll are slightly elevated relative to other parts so that transfer of the cut end mark in the roll core is prevented. Although the heat process may be carried out after film forming, after surface process, after application of back layer (e.g., antistatic agent, slicking agent or the like) and after application of primer, the heat process is carried out preferably after the application of an anti-static agent.

An ultraviolet absorber may be blended into the polyester. Further, in order to prevent light piping, a dye or pigment, commercialized for polyester use under the names of "Diaresin" (from Mitsubishi Chemical Industries, Co., Ltd.) or "Kayaset" (from Nihon Kayaku Co., Ltd.) may be blended into the polyester.

A film patrone (a film case), into which the light-sensitive material of the present invention may be encased, is explained below. The main material of the film patrone may be a metal or a synthetic plastic.

Preferred examples of the plastic material include polystyrene, polyethylene, polypropylene and polyphenyl ether. The film patrone may contain an anti-static agent, examples of which include carbon black, metal oxide grains, surfactants, such nonionic, anionic, cationic or betaine-based surfactants, and polymers. Examples of the film patrones, which have been rendered antistatic, are described in Japanese Patent Application Laid-Open (JP-A) Nos. 1-312,537 and 1-312,538. The resistivity of the film patrone is preferably $10^{12}$ Ω·cm or less in a condition of 25° C. and 25% RH. Normally, carbon black or a pigment is incorporated into the plastic film patrone in order to afford shading. The size of the film patrone may be the 135 size which is currently employed (the diameter of cartridge of the 135 size is 25 mm). For use in a small-sized camera, a film patrone having a diameter of the cartridge of 22 mm or less may be used. The patrone volume of the film patrone is 30 $cm^3$ or less, preferably 25 $cm^3$ or less. The weight of the plastics for a film patrone is preferably in the range of 5 to 15 g.

A film patrone which feeds out film by the rotation of a spool may be used for the light-sensitive material of the present invention. A film patrone wherein the end of the film is fed from the port of the film patrone to the outside by rotating the spool axis in the direction of the feed of the film can also be used. These film patrones are described in U.S. Pat. Nos. 4,834,306 and 5,226,613.

As for the method to form an image on a sheet of color paper or on a light-sensitive material for heat development, the methods, which are described in Japanese Patent Application Laid-Open (JP-A) Nos. 5-241,251, 5-19,364 and 5-19,363, can be used.

EXAMPLES

In order to better explain the present invention, the following examples are given by way of illustration and not by way of limitation.

Example 1

(1) Preparation of Host Grains

Host Grains A 1000 cc of aqueous solution containing 0.5 g of low molecular weight gelatin (weight average molecular weight: 15,000) and 0.37 g of KBr were stirred at 40° C. and then 20 cc of 0.3M $AgNo_3$ aqueous solution and 20 cc of 0.3M KBr aqueous solution were simultaneously added to the gelatin solution in 40 seconds by means of a double jet. Then, after the pAg was adjusted to 9.9, the temperature was raised to 75° C. for 35 minutes, 35 g of oxidation-treated gelatin were added to the resultant solution, 734 cc of 1.2M $AgNO_3$ aqueous solution were added for 41 minutes under acceleration of flow (the flow at the time of finishing was 6.2 times that at the time of starting) while 1.2M (KBr+KI) aqueous solution containing 2 mole % of KI were added simultaneously so as to maintain the pAg at 8.58. After 35 minutes from the start of this addition, a solution containing $K_2IrCl_6$ in an amount of $2\times10^{-8}$ mole per mole of silver.

Then, the resultant emulsion was cooled to 35° C., and rinsed by conventional flocculation method, and 75 g of gelatin were added thereto to produce a pH of 5.5 and a pAg of 8.2.

In the grains obtained, the total projected area of tabular grains exceeded 99% of the total projected area of all the grains and the average diameter of spheres which have equivalent grain volumes was 0.68 μm.

The average thickness of the resultant grains was 0.062 μm, the average diameter of circles each having the same area as the projected area of a grain was 1.84 μm and the average aspect ratio was 30. These values were obtained by means of the reprica method.

Host Grains B 100 cc of aqueous solution containing 0.5 g of low molecular weight gelatin (weight average molecular weight: 15,000) and 0.37 g of KBr were stirred at 40° C. and then 20 cc of 0.3M $AgNO_3$ aqueous solution and 20 cc of 0.3M KBr aqueous solution were simultaneously added to the gelatin solution in 40 seconds by means of a double jet. Then, after the pAg was adjusted to 9.9, the temperature was raised to 75° C. for 35 minutes, 35 g of oxidation-treated gelatin were added to the resultant solution. 549 cc of 1.2M $AgNO_3$ aqueous solution were added for 35 minutes under acceleration of flow (the flow at the time of finishing was 5.4 times that at the time of starting) while 1.2M (KBr+KI) aqueous solution containing 2 mole % of KI were added simultaneously so as to maintain the pAg at 8.58. Then, a solution containing $K_2IrCl_6$ was added in an amount of $2\times10^{-8}$ mole per mole of silver. In addition, 185 cc of 1.2M $AgNO_3$ aqueous solution were added at a constant flow for 6 minutes while 1.2M (KBr+KI) aqueous solution containing 12 mole % of KI was simultaneously added so as to maintain the pAg at 8.58.

Then, the resultant emulsion was cooled to 35° C., and rinsed by conventional flocculation method, and 75 g of gelatin were added thereto to produce a pH of 5.5 and a pAg of 8.2.

In the grains obtained, the total projected area of tabular grains exceeded 99% of the total projected area of all the grains and the average diameter of spheres which have equivalent grain volumes was 0.68 μm.

The average thickness of the resultant grains was 0.065 μ, the average diameter of circles each having the same area as the projected area of a grain was 1.80 μm and the average aspect ratio was 28.

(2) Preparation of silver halide epitaxy and chemical sensitization

Emulsion 1-A (Comparative emulsion)

After 5 cc of 0.06M KI aqueous solution were added to Host Grains A (emulsion) at 40° C., and at pH=6.2 and pAg=9.0, a sensitizing dye I for green-sensitive emulsion described below were added to the resultant emulsion in an amount of $2.0\times10^{-3}$ mole per mole of silver. Then, potassium thiocyanate, chloroauric acid, sodium thiosulfate, and compound I were added to the emulsion in order to perform spectral sensitization and chemical sensitization. The amount of chemical sensitizer was controlled so that the sensitivity of the emulsion at 1/100 second exposure became a maximum.

Sensitizing dye I for green-sensitive emulsion

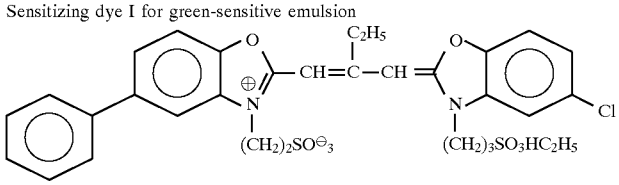

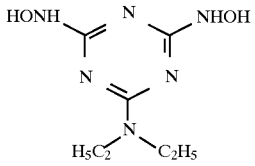

Compound I

Emulsion 1-B (emulsion for the present invention)

After 5 cc of 0.06M KI aqueous solution were added to Host Grains A (emulsion) at 40° C., and at pH=6.2 and pAg=9.0, a sensitizing dye I for green-sensitive emulsion described above was added to the resultant emulsion in an amount of $2.0\times10^{-3}$ mole per mole of silver. Then, 30 cc of 1.2M NaCl aqueous solution, 30 cc of 1.2M of KBr aqueous solution, 0.64M KI aqueous solution, 70 cc of 1.2M $AgNO_3$ aqueous solution were added to the emulsion in that order. Next, potassium thiocyanate, chloroauric acid, sodium thiosulfate, and compound I to perform spectral sensitization and chemical sensitization. The amount of chemical sensitizer was controlled in the same manner as in the preparation of Emulsion 1-A.

The resultant grains were observed by scanning electron microscope. Silver halide epitaxies were observed mainly on the corner portions and edge portions of the grains.

Emulsion 1-C (emulsion for the present invention)

The same procedure as described in the preparation of Emulsion 1-B was repeated, except that Host Grain B was used instead of Host Grain A.

The resultant grains were observed by scanning electron microscope. Silver halide epitaxies were observed mainly on the corner portions and edge portions of the grains.

Emulsion 1-D (emulsion for the present invention)

The same procedure as described in the preparation of Emulsion 1-C was repeated, except that a solution containing $K_4RuCN_6$ at $5.6\times10^{-5}$ moles per mole of silver was added after an addition of 30 cc of 1.2M KBr aqueous solution.

The resultant grains were observed by scanning electron microscope. Silver halide epitaxies were observed mainly on the corner portions and edge portions of the grains.

(3) Preparation of dispersion and coated material, and evaluation thereof

A dispersion of zinc hydroxide used as the base precursor was prepared.

31 g of zinc hydroxide powder with primary particles having a particle size of 0.2 μm, 1.6 g of carboxymethyl cellulose and 0.4 g of sodium polyacrylate as dispersants, 8.5 g of lime-treated ossein gelatin, and 158.5 ml of water were mixed. Then, the resultant mixture was dispersed for one hour by means of a mill using glass beads. After dispersion, the glass beads were removed and 188 g of a zinc hydroxide dispersion was obtained.

An dispersion of a magenta coupler was prepared.

7.80 g of magenta coupler (a), 5.45 g of developing agent (b), 2 mg of anti-fogging agent (c), 8.21 g of organic solvent having high boiling point (d), and 24.0 ml of ethyl acetate were dissolved at 60° C. to obtain a solution. The solution previously prepared was added to 150 g of aqueous solution containing 12.0 g of lime-treated gelatin and 0.6 g of sodium dodecylbenzenesulfonate and mixed therewith. Then, the resultant mixture was dispersed for 20 minutes by means of a dissolver agitator at 10,000 r.p.m. After completion of the dispersion, distilled water was added to the resultant dispersion to give a total amount of 300 g and mixed therewith for 10 minutes at 2,000 r.p.m.

Magenta coupler (a):

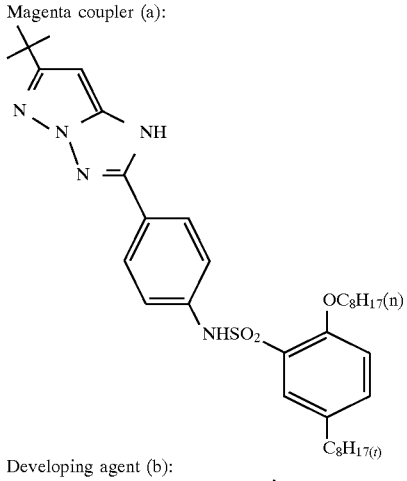

Developing agent (b):

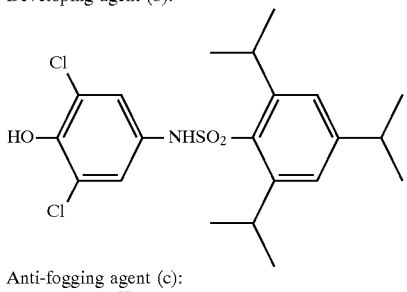

Anti-fogging agent (c):

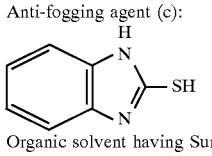

Organic solvent having Surfactant (e):
a high boiling point (d):

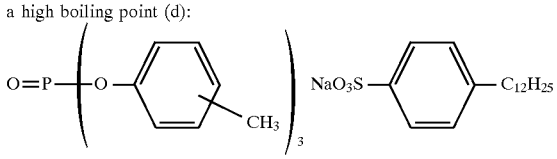

These dispersions were combined with Emulsions 1-A to 1-D to prepare the compositions shown in Table 1. Then, the compositions were applied to a substrate to prepare single layered heat developable color photographic light-sensitive materials (Samples 101 to 104).

Samples thus prepared were kept for 7 days at 25° C. and 65% relative humidity and then cut.

TABLE 1

Samples 101 to 104

| Layer configuration | Coating material | Coating weight (mg/m$^2$) |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | 98 |
| Intermediate layer | Lime-treated gelatin | 375 |
| | Surfactant (g) | 15 |
| | Zinc hydroxide | 1100 |
| | Water-soluble polymer (h) | 15 |
| Magenta dye forming layer | Lime-treated gelatin | 2000 |
| | Emulsion (based on amount of coated silver) | 1726 (any one of Emulsions 1-A to 1-D) |
| | Magenta coupler (a) | 637 |
| | Developing agent (b) | 444 |
| | Anti-fogging agent (c) | 0.2 |
| | Organic solvent having high boiling point (d) | 670 |
| | Surfactant (e) | 33 |
| | Water-soluble polymer (h) | 14 |
| Transparent PET base (120 $\mu$m) | | |

Next, a processing material P-1 of the composition shown in Tables 2 and 3 was prepared.

TABLE 2

Composition of processing Material P-1

| Constituent layer | Added substance | Amount added (mg/m$^2$) |
|---|---|---|
| 4th layer Protective layer | Acid-treated gelatin | 220 |
| | Water-soluble polymer (j) | 60 |
| | Water-soluble polymer (k) | 200 |
| | Additive (1) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer Intermediate layer | Lime-treated gelatin | 240 |
| | Water-soluble polymer (k) | 24 |
| | Hardener (p) | 180 |
| | Surfactant (e) | 9 |
| 2nd layer Base generating layer | Lime-treated gelatin | 2400 |
| | Water-soluble polymer (k) | 360 |
| | Water-soluble polymer (q) | 700 |
| | Water-soluble polymer (r) | 600 |
| | Organic solvent having a high boiling point (s) | 2000 |
| | Additive (t) | 20 |
| | Potassium hydantoin | 260 |
| | Guanidine Picolinic acid | 2910 |
| | Potassium quinolinate | 225 |
| | Sodium quinolinate | 180 |
| | Surfactant (e) | 24 |
| 1st layer Prime layer | Lime-treated gelatin | 280 |
| | Water-soluble polymer (j) | 12 |
| | Surfactant (g) | 14 |
| | Hardener (p) | 185 |
| Transparent substrate A (63 $\mu$m) | | |

TABLE 3

Composition of the transparent substrate A

| Name of layer | Composition | Weight (mg/m$^2$) |
|---|---|---|
| Prime layer on the front side | Gelatin | 100 |
| Polymer layer | Polyethylene terephthalate | 62500 |
| Prime layer on the reverse side | Methyl methacrylate/styrene/2-ethylhexyl acrylate/methacrylic acid copolymer | 1000 |
| | PMMA latex (average particle diameter: 12 $\mu$) | 120 |
| | | 63720 |

Surfactant (f)

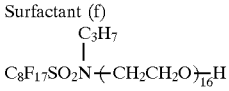

Surfactant (g)

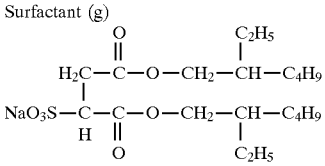

Water-Solublepolymer (h)

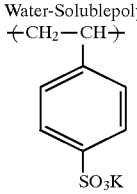

Hardener (i)

$CH_2{=}CH{-}SO_2{-}CH_2{-}SO_2{-}CH{=}CH_2$

Water-soluble polymer (j):
K-carrageenan

-continued

Water-soluble polymer (k):
Sumikagel L-5H (from Sumitomo Chemical Co., Ltd.)

Additive (1):

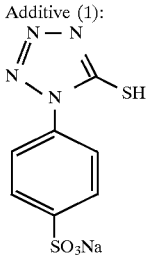

Matting Agent (m):
SYLOID 79 (from Fuji-Davison Chemical Co., Ltd.)

Surfactant (n):

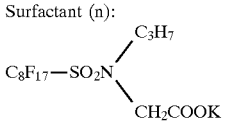

Surfactant (o)

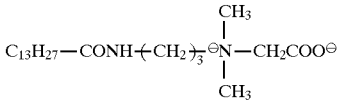

Hardener (p):

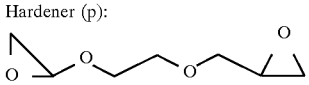

Water-soluble polymer (q):
Dextran (molecular weight: 70,000)

Water-soluble polymer (r):
MP Polymer MP 102 (from Kuraray Co., Ltd.)

Organic solvent having a high boiling point (s):
EMPARA 40 (from Ajinomoto Co., Ltd.)

Additive (t):

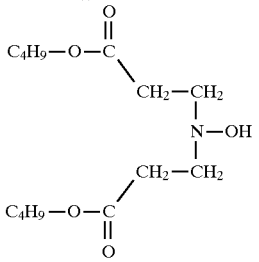

These Samples 101 to 104 were evaluated for sensitivity, granularity and storage life.

Measurement of sensitivity

These samples 101 to 104 were subjected to 1/100 seconds exposure at 1000 Lux via an optical wedge and green filter.

15 ml/m$^2$ of hot water at 40° C. were applied to light-sensitive layers of these samples 101 to 104 which have been exposed. Then, Samples 101 to 104 were placed on processing materials P-1 so as to apply the surface of said light-sensitive layer to the surface of the processing layer of processing material P-1, and were subjected to heat development at 83° C. for 30 seconds by using a heat drum. After the processing, Samples 101 to 104 were removed from the processing material P-1. A magenta wedge-shaped image (first processing) formed in each of the samples 101 to 104 was obtained. Next, samples 101 to 104 were subjected to the processing of the second step (bleach-fix processing) by making use of processing materials P-2 shown in Table 4.

TABLE 4

Composition of processing material P-2

| Layer configuration | Coating material | Coating weight (mg/m$^2$) |
|---|---|---|
| Protective layer (Fourth layer) | Acid-treated gelatin | 220 |
| | Water-soluble polymer (j) | 60 |
| | Water-soluble polymer (k) | 200 |
| | Additive (I) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant(o) | 10 |
| Intermediate layer (Third layer) | Lime-treated gelatin | 240 |
| | Water-soluble polymer (k) | 24 |
| | Hardener (p) | 180 |
| | Surfactant (e) | 9 |
| Base generating layer (Second layer) | Lime-treated gelatin | 2400 |
| | Water-soluble polymer (k) | 360 |
| | Water-soluble polymer (q) | 700 |
| | Water-soluble polymer (r) | 600 |
| | Compound (described below) | 4000 |
| | Surfactant (e) | 20 |
| Substratum (First layer) | Lime-treated gelatin | 280 |
| | Water-soluble polymer (j) | 12 |
| | Surfactant (g) | 14 |
| | Hardener (p) | 185 |
| Transparent substrate A (63 μm) | | |

Compound

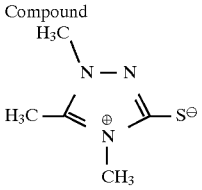

In the processing of the second step, the surface of the processing layer of processing material P-2 was coated with 10 cc/m$^2$ of water, and then Samples 101 to 104 were placed on the processing materials P-2 so as to apply the surface of processing layer of processing material P-2 to the surface of the light-sensitive layer of Samples 101 to 104 processed in the first step, and were heated at 60° C. for 30 seconds.

A transmission density of wedge-shaped image of Samples 101 to 104 thus processed was measured to obtain a characteristic curve. The sensitivity was given by a relative value obtained by taking the reciprocal of the exposure amount corresponding to density higher than fog density by 0.2 and by regarding the reciprocal of sample 101 as 100.

Measurement of granularity Samples 101 to 104 were exposed so that magenta color density became 1.0 and were subjected to the above heat development. RMS value was measured by using a diffuse light source and an aperture of 48 μm diameter. The granularity was given by a relative value obtained by taking the reciprocal of the RMS value obtained and by regarding the reciprocal of sample 101 as 100.

Measurement of storage life

Samples 101 to 104 were preserved for 5 days at 60° C. and a relative humidity of 30%. Independently, other Samples 101 to 104 were preserved for 5 days at 25° C. and a relative humidity of 65%. Then, these samples 101 to 104 were subjected to exposure and heat development processing in the same manner is in measurement of sensitivity to obtain characteristic curves. The sensitivity was shown by the exposure amount corresponding to density higher than fog density by 0.2. The difference between the sensitivities of the two samples which had the same sample number and which had been stored at 60° C. and a relative humidity of 30% and stored at 25° C. and a relative humidity of 65%, respectively, was given as a logarithm [$\Delta S = \log_{10}$ (difference between the sensitivities)].

Further, in order to compare the storage life above described with that when the development processing was carried out by use of a processing bath containing conventional color developing agent, the same procedure as above described was repeated, except that processing CN-16 for color negative was substituted for heat development processing and development carried out by use of a processing bath at a temperature of 38° C. and for 165 seconds. The difference between the sensitivities of the two samples which had the same sample number and which had been stored at 60° C. and a relative humidity of 30% and stored at 25° C. and a relative humidity of 65%, respectively, was given as a logarithm [$\Delta S = \log_{10}$ (difference between the sensitivities)].

The results are shown in Table 5.

TABLE 5

| Sample No. | Type of emulsion | Sensitivity | Granularity | Storage life(ΔS) Heat development processing without processing bath | Storage life(ΔS) CN-16 processing | Note |
|---|---|---|---|---|---|---|
| 101 | 1-A | 100 | 100 | 0.55 | 0.52 | Comparative example |
| 102 | 1-B | 132 | 115 | 0.15 | 0.51 | Present invention |
| 103 | 1-C | 135 | 131 | 0.14 | 0.52 | Present invention |
| 104 | 1-D | 148 | 130 | 0.14 | 0.50 | Present invention |

It can be seen from the results that in silver halide color photographic light-sensitive material containing developing agent, the sample of the present invention using an emulsion containing epitaxial silver halide grains having at least a silver salt epitaxy formed on the surface of the silver halide tabular grains acting as a host is excellent in sensitivity, granularity and shows small differences in sensitivity (ΔS), and significantly improved storage life.

emulsion described below was used in Emulsions F to H.

sensitizing dye II for blue-sensitive emulsion

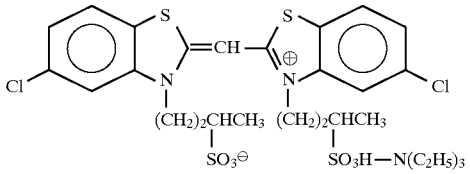

sensitizing dye III for red-sensitive emulsion

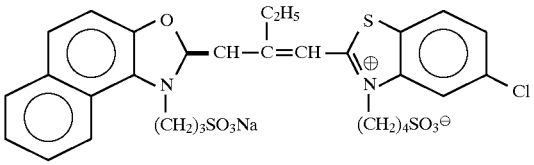

sensitizing dye IV for red-sensitive emulsion

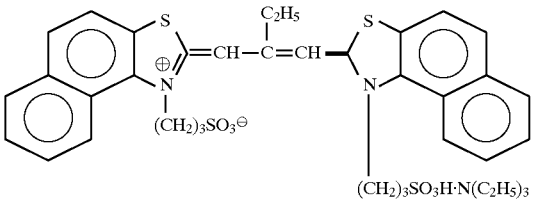

sensitizing dye V for red-sensitive emulsion

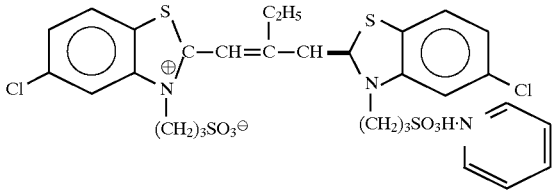

mixture in mole ratio of III:IV:V = 40:2:58

TABLE 6

| Type of emulsion | Average content of AgI (%) | Average grain diameter (μm) | Coefficient variation for grain diameter (%) | Ratio of diameter to thickness | Ratio of amount of silver [core/intermediate/shell] (AgI content) | Configuration and shape of grain |
|---|---|---|---|---|---|---|
| Emulsion A | 6.3 | 1.07 | 22 | 4.0 | [2/63/35](1/7/) | Tablular grain of triple configuration |
| Emulsion B | 8.8 | 0.64 | 20 | 5.2 | [7/64/29](0/108) | Tablular grain of triple configuration |
| Emulsion C | 3.7 | 0.37 | 15 | 2.6 | [5/30/65](0.5/0/5) | Tablular grain of triple configuration |
| Emulsion D | 4.7 | 0.86 | 20 | 5.0 | [3/64/33](1/3/9) | Tablular grain of triple configuration |
| Emulsion E | 3.7 | 0.49 | 17 | 3.2 | [5/35/60](0/0/6) | Tablular grain of triple configuration |
| Emulsion F | 4.7 | 0.86 | 20 | 5.0 | [3/64/33](1/3/9) | Tablular grain of triple configuration |
| Emulsion G | 5.4 | 0.65 | 20 | 5.4 | [1/68/31](0/2/13) | Tablular grain of triple configuration |
| Emulsion H | 3.7 | 0.49 | 17 | 3.2 | [5/35/60](0/0/6) | Tablular grain of triple configuration |

Example 2

Emulsions A to H shown in Table 6 were prepared in a similar manner as the method of preparation of the tabular emulsion described in Japanese Patent Application Laid-Open (JP-A) No. 1-329,231 and the grain size was controlled. A sensitizing dye for blue-sensitive emulsion II described below was used in Emulsions A to C, a sensitizing dye for green-sensitive emulsion I aforesaid was used in Emulsions D to E, and a sensitizing dye for red-sensitive Cyan and yellow coupler dispersions were also prepared in accordance with the method of preparation of the coupler dispersion of Example 1.

For the purpose of the formation of a colored layer capable of fading at the time of the heat development process, a colorant dispersion was prepared by combination of yellow, magenta and cyan leuco dyes described below and a zinc complex.

The compounds used are shown below.

yellow coupler (u)
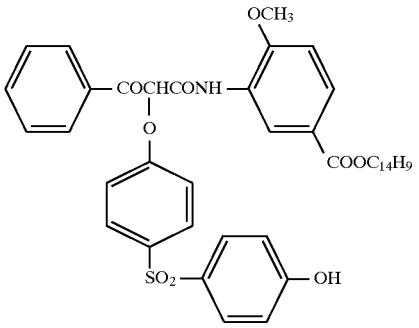
developing agent (v)
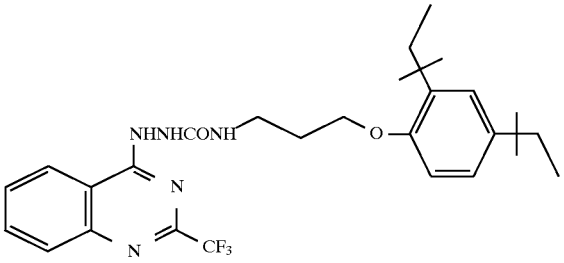
anti-fogging agent (w)
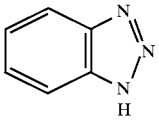
cyan coupler (aa)
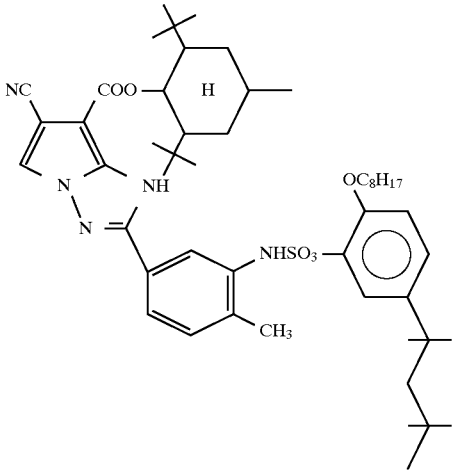
leuco dye (ab)
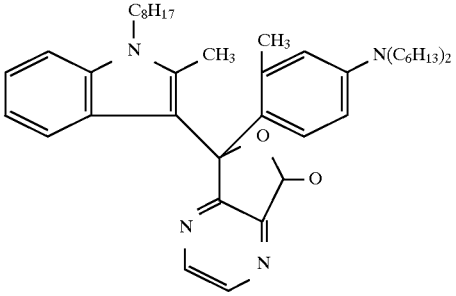

-continued yellow color leuco dye (x)

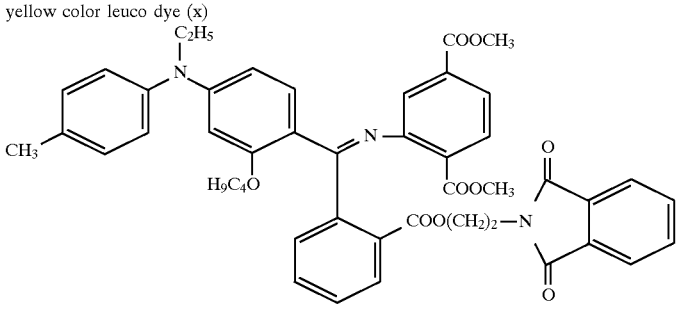

developer (y)

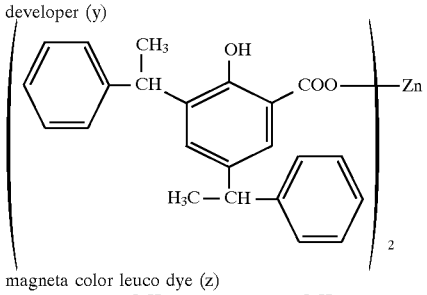

magneta color leuco dye (z)

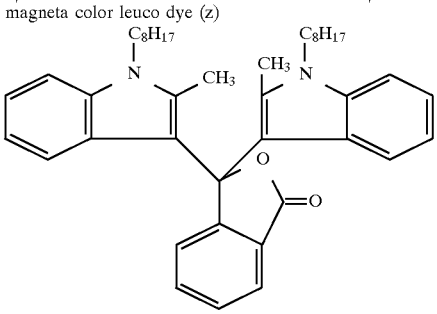

Samples 201 to 204 of the heat developable color light-sensitive material of multiple-layer configuration shown in Tables 7 to 11 were prepared by using a silver halide emulsion, coupler dispersion and colorant dispersion which were thus obtained as well as Emulsions 1-A to 1-D described in Example 1.

Samples thus prepared were preserved for 7 days at 25° C. and at a relative humidity of 65% and then cut.

TABLE 7

Samples 201 to 204

| Layer configuration | Coating material | Coating weight ($mg/m^2$) |
|---|---|---|
| Protective layer (14th layer) | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (I) | 98 |
| Intermediate layer (13th layer) | Lime-treated gelatin | 375 |
| | Surfactant (g) | 15 |
| | Zinc hydroxide | 1100 |
| | Water-soluble polymer (h) | 15 |
| Yellow dye forming layer (High-sensitivity layer) (12th layer) | Lime-treated gelatin | 150 |
| | Emulsion (based on amount of coated silver) | Emulsion A 647 |
| | Yellow coupler (u) | 57 |
| | Developing agent (v) | 41 |

TABLE 7-continued

Samples 201 to 204

| Layer configuration | Coating material | Coating weight ($mg/m^2$) |
|---|---|---|
| | Anti-fogging agent (w) | 4 |
| | Organic solvent having high boiling point (d) | 50 |
| | Surfactant (e) | 3 |
| | Water-soluble polymer (h) | 1 |

TABLE 8

| Layer configuration | Coating material | Coating weight ($mg/m^2$) |
|---|---|---|
| Yellow dye forming layer (medium sensitivity layer) (11th layer) | Lime-treated gelatin | 220 |
| | Emulsion (based on amount of coated silver) | Emulsion B 475 |
| | Yellow coupler (u) | 84 |
| | Developing agent (v) | 60 |
| | Anti-fogging agent (w) | 6 |
| | Organic solvent having high boiling point (d) | 74 |
| | Sunfactant (e) | 4 |
| | Water-soluble polymer (h) | 2 |
| Yellow dye forming layer (low sensitivity layer) | Lime-treated gelatin | 1420 |
| | Emulsion (based on amount of | Emulsion C |

TABLE 8-continued

| Layer configuration | Coating material | Coating weight (mg/m$^2$) |
|---|---|---|
| (10th layer) | coated silver) | 604 |
| | Yellow coupler (u) | 532 |
| | Developing agent (v) | 382 |
| | Anti-fogging agent (w) | 40 |
| | Organic solvent having high boiling point (d) | 469 |
| | Surfactant (e) | 23 |
| | Water-soluble polymer (h) | 10 |
| Intermediate layer (9th layer) | Lime-treated gelatin | 750 |
| | Surfactant (e) | 15 |
| | Leuco dye (x) | 303 |
| | Developer (y) | 433 |
| | Water-soluble polymer (h) | 15 |

TABLE 9

| Layer configuration | Coating material | Coating weight (mg/m$^2$) |
|---|---|---|
| Magenta dye forming layer (high sensitivity layer) (8th layer) | Lime-treated getatin | 150 |
| | Emulsion (based on amount of coated silver) | Emulsion D 647 |
| | Magenta coupler (a) | 48 |
| | Developing agent (b) | 33 |
| | Anti-fogging agent (c) | 0.02 |
| | Organic solvent having high boiling point (d) | 50 |
| | Surfactant (e) | 3 |
| | Water-soluble polymer (h) | 1 |
| Magenta dye forming layer (medium sensitivity layer) (7th layer) | Lime-treated gelatin | 150 |
| | Emulsion (based on amount of coated silver) | (any one of emulsions 1-A to 1-D) 475 |
| | Magenta coupler (a) | 70 |
| | Developing agent (b) | 49 |
| | Anti-fogging agent (c) | 0.02 |
| | Organic solvent having high boiling point (d) | 74 |
| | Surfactant (e) | 4 |
| | Water-soluble polymer (h) | 2 |
| Magenta dye forming layer (low sensitivity layer) (6th layer) | Lime-treated gelatin | 1400 |
| | Emulsion (based on amount of coated silver) | Emulsion E 604 |
| | Magenta coupler (a) | 446 |
| | Developing agent (b) | 311 |
| | Anti-fogging agent (c) | 0.14 |
| | Organic solvent having high boiling point (d) | 469 |
| | Surfactant (e) | 23 |
| | Water-soluble polymer (h) | 10 |

TABLE 10

| Layer configuration | Coating material | Coating weight (mg/m$^2$) |
|---|---|---|
| Intermediate layer (5th layer) | Lime-treated gelatin | 900 |
| | Surfactant (e) | 15 |
| | Leuco dye (z) | 345 |
| | Developer (y) | 636 |
| | Zinc hydroxide | 1100 |
| | Water-soluble polymer (h) | 15 |
| Cyan dye forming layer (high sensitivity layer) (4th layer) | Lime-treated gelatin | 150 |
| | Emulsion (based on amount of coated silver) | Emulsion F 647 |
| | Cyan coupler (aa) | 65 |

TABLE 10-continued

| Layer configuration | Coating material | Coating weight (mg/m$^2$) |
|---|---|---|
| | Developing agent (b) | 33 |
| | Anti-fogging agent (c) | 0.03 |
| | Organic solvent having high boiling point (d) | 50 |
| | Surfactant (e) | |
| | Water-soluble polymer (h) | 3 |
| | | 1 |
| Cyan dye forming layer (medium sensitivity layer) (Third layer) | Lime-treated gelatin | 220 |
| | Emulsion (based on amount of coated silver) | Emulsion G 475 |
| | Cyan coupler (aa) | 96 |
| | Developing agent (b) | 49 |
| | Anti-fogging agent (c) | 0.05 |
| | Organic solvent having high boiling point (d) | 74 |
| | Surfactant (e) | |
| | Water-soluble polymer (h) | 4 |
| | | 2 |

TABLE 11

| Layer configuration | Coating material | Coating weight (mg/m$^2$) |
|---|---|---|
| Cyan dye forming layer (low sensitivity layer) (Second layer) | Lime-treated gelatin | 1400 |
| | Emulsion (based on amount of coated silver) | Emulsion H 604 |
| | Cyan coupler (aa) | 610 |
| | Developing agent (b) | 311 |
| | Anti-fogging agent (c) | 0.32 |
| | Organic solvent having high boiling point (d) | 469 |
| | Surfactant (e) | |
| | Water-soluble polymer (h) | 23 |
| | | 10 |
| Anti-halation coating (First layer) | Lime-treated gelatin | 750 |
| | Surfactant (e) | 15 |
| | Leuco dye (ab) | 243 |
| | Developer (y) | 425 |
| | Water-soluble polymer (h) | 15 |
| Transparent PET base (120 $\mu$m) | | |

Measurement of sensitivity

These light-sensitive materials were subjected to 1/100 seconds exposure at 1000 Lux via an optical wedge.

15 ml/m$^2$ of hot water at 40° C. were applied to light-sensitive layers of these Samples 201 to 204 which have been exposed. Then, Samples 201 to 204 were placed on processing materials P-1 so as to apply the surface of said light-sensitive layer on the surface of processing layer of processing material P-1 used in Example 1, and were subjected to heat development at 83° C. for 30 seconds by using heat drum. After the processing, Samples 201 to 204 were removed. The transmission density of wedge-shaped magenta image was measured by using a green filter to obtain a characteristic curve. Similar to the manner described in Example 1, the sensitivity was given by a relative value obtained by taking the reciprocal of the exposure amount corresponding to density higher than fog density by 0.2 and regarding the reciprocal of Sample 201 as 100.

Measurement of granularity

Samples 201 to 204 were exposed so that magenta color density became 1.0 and were subjected to the above heat development. RMS value was measured by using a diffuse light source and an aperture of 48 $\mu$m diameter. The granularity was given as a relative value obtained by taking the reciprocal of the RMS value obtained and by regarding the reciprocal of Sample 201 as 100.

Measurement of storage life

Samples 201 to 204 were preserved for 5 days at 60° C. and a relative humidity of 30%. Independently, other Samples 201 to 204 were preserved for 5 days at 25° C. and a relative humidity of 65%. Then, samples 201 to 204 were subjected to exposure and heat development processing in the same manner is in measurement of sensitivity to obtain characteristic curves. The sensitivity was shown by the exposure amount corresponding to density higher than fog density by 0.2. The difference between the sensitivities of the two samples which had the same sample number and which had been stored at 60° C. and a relative humidity of 30% and stored at 25° C. and a relative humidity of 65%, respectively, was given as a logarithm [$\Delta S=\log_{10}$ (difference between the sensitivities)].

Further, in order to compare the storage life above described with that when the development processing was carried out by use of a processing bath containing conventional color developing agent, the same procedure as above described was repeated, except that processing CN-16 for color negative was substituted for heat development processing and development carried out by use of a processing bath at a temperature of 38° C. and for 165 seconds. The difference between the sensitivities of the two samples which had the same sample number and which had been stored at 60° C. and a relative humidity of 30% and stored at 25° C. and a relative humidity of 65%, respectively, was given as a logarithm [$\Delta S=\log_{10}$ (difference between the sensitivities)].

The results are shown in Table 12.

TABLE 12

| Sample No. | Type of emulsion | Sensitivity | Granularity | Storage life(ΔS) Heat development processing without processing bath | Storage life(ΔS) CN-16 processing | Note |
|---|---|---|---|---|---|---|
| 201 | 1-A | 100 | 100 | 0.50 | 0.49 | Comparative example |
| 202 | 1-B | 129 | 118 | 0.13 | 0.49 | Present invention |
| 203 | 1-C | 129 | 135 | 0.12 | 0.48 | Present invention |
| 204 | 1-D | 141 | 135 | 0.12 | 0.48 | Present invention |

It can be seen from the results that, as in Example 1, in silver halide color photographic light-sensitive material containing developing agent, the sample of the present invention using an emulsion containing epitaxial silver halide grains having at least a silver salt epitaxy formed on the surface of the silver halide tabular grains acting as a host is excellent in sensitivity, granularity and shows small differences in sensitivity (ΔS), and significantly improved storage life.

Example 3

Samples were prepared the manner described in Example 2, except that the substrate prepared by the method described below was substituted for the substrate used in Example 2. And then, tests were carried. Excellent results like those of Example 2 and the effects of the present invention were confirmed.

1) Substrate

A PEN film having a thickness of 90 μm was obtained by the procedure comprising drying 100 parts by weight of a polyethylene 2,6-naphthalate polymer and 2 parts by weight of Tinuvin P. 326 (from Ciba-Geigy Co., Ltd.) as an ultraviolet ray absorber, melting them at 300° C., and extruding through a T-shaped die, stretching the extrudate 3.3 times the original length in the machine direction at 140° C., stretching the extrudate 3.3 times the original length in the transverse direction at 130° C. and thermally fixing the stretched film at 250° C. for 6 seconds. Prior to the preparation. An appropriate amount of a blue dye, a magenta dye and a yellow dye (I-1, I-4, I-6, I-24, I-26, I-27 and II-5 described in JIII Journal of Technical Disclosure No. 94-6,023) had been added to the PEN film, respectively. The PEN film was wound on a stainless steel core having a diameter of 20 cm and given a thermal hysteresis at 110° C. for 48 hours to produce a low-curling substrate.

2) Application of a substratum

Both sides of the substrate underwent a sequence of processes comprising a corona discharge process, a UV irradiation and a glow discharge process. Then, a substratum was formed on both sides by the application of a substratum forming solution comprising the following materials: gelatin: 0.1 g/m$^2$, sodium α-sulfo-di-2-ethylhexyl succinate: 0.01 g/m$^2$, salicylic acid: 0.04 g/m$^2$, p-chlorophenol: 0.2 g/m$^2$, $(CH_2{=}CHSO_2CH_2CH_2NHCO)_2CH_2$: 0.012 g/m$^2$, and a polyamide/epichlorohydrin polycondensation product: 0.02 g/m$^2$ (by use of a 10 cc/m2 bar coater). After the application thereof, the substratum was dried at 115° C. for 6 minutes (all transportation devices including rollers in the drying zone were kept at 115° C.).

3) Application of back layers

One side of the substrate coated with the above-described substratum, was coated with an anti-static layer, a transparent magnetic recording layer and a slicking layer, successively as back layers, and having the following compositions.

3-1) Application of an anti-static layer

An anti-static layer was formed by the application of a solution comprising the following materials: a dispersion of fine grains (having an average grain diameter of secondary grains: 0.08 μm) made up of a tin-oxide/antimony-oxide complex oxide having an average grain diameter of 0.005 μm and a resistivity of 5 Ω·cm: 0.2 g/m$^2$, gelatin: 0.05 g/m$^2$, $(CH_2{=}CHSO_2CH_2CH_2NHCO)_2CH_2$: 0.02 g/m$^2$, a polyoxyethylene-p-nonylphenol(degree of polymerization: 10): 0.005 g/m$^2$ and resorcinol.

3-2) Application of a transparent magnetic recording layer

A magnetic recording layer having a thickness of 1.2 μm was formed by coating the substrate with cobalt/γ-iron oxide grains coated with 3-polyoxyethylene-propyloxytrimethoxysilane (degree of polymerization: 15) (15 weight percent), having a specific surface area of 43 m$^2$ g, a major axis of 0.14 μm, a minor axis of 0.03 μm, a saturation magnetization of 89 emu/g, $Fe^{+2}/Fe^{+3}$=6/.94 and surface-coated with aluminum oxide/silicon oxide in an amount corresponding to 2 weight percent of the iron oxide: 0.06 g/m$^2$, utilizing diacetylcellulose: 1.2 g/m$^2$ (the dispersion of the iron oxide was carried out by means of an open kneader and a sand mill), $C_2H_5C(CH_2CONH{-}C_6H_3(CH_3)NCO)_3$: 0.3 g/m$^2$ as a hardener together with acetone, methyl ethyl ketone and dibutyl phthalate as solvents, by use of a bar coater. The following were added to the magnetic recording layer: a slicking agent, i.e., $C_6H_{13}CH(OH)C_{10}H_{20}COOC_{40}H_{81}$: 50 mg/m$^2$ a matting agent, i.e., silica grains (1.0 μm): 50 mg/m$^2$ and an abrasive, i.e., aluminum oxide grains (0.2 μm and 1.0 μm) coated with 3-polyoxyethylene-propyloxytrimethoxysilane (degree of polymerization: 15) (15 weight percent): 10 mg/r$^2$. After the application thereof, the magnetic recording layer was dried at 115° C. for 6 minutes (all transportation devices including rollers in the drying zone were kept at 115° C.). The magnetic recording layer exhibited a color density $D^B$ increment under X-light (blue filter) of about 0.1, a saturation magnetization moment of 4.2 emu /g, a coercive force of $7.3\times10^4$ A/m and a polygonal rate of 65%.

3-3) Application of a slicking layer

The substrate was coated with hydroxy ethyl cellulose (25 mg/M$^2$) together with a mixture of $C_6H_{13}CH(OH)C_{10}H_{20}COOC_{40}H_{81}$ (6 mg/M$^2$) and silicone oil BYK-310 (Available from Bic Chemie Japan Co.,Ltd.: 1.5 mg/m$^2$). This coating composition was prepared in the following way: melting the above-mentioned mixture in a blend of xylene/propylene glycol monomethyl ether (1/1) at 105° C., emulsifying the product in propylene glycol monomethyl ether (in an amount 10 times that of the mixture) at room temperature, dispersing the resultant emulsion in acetone to prepare a dispersion (having an average grain diameter of 0.01 μm), and adding the dispersion to the hydroxy ethyll cellulose. After the application thereof, the slicking layer was dried at 115° C. for 6 minutes (all transportation devices including rollers in the drying zone were kept at 115° C.). The slicking layer exhibited excellent properties characterized by a coefficient of dynamic friction of 0.10 (utilizing a stainless steel hard ball having a diameter of 5 mm and a load of 100 g at a speed of 6 cm/minute), a coefficient of static friction of 0.08 (clip method) and a coefficient of dynamic friction against an emulsion-coated surface of 0.15.

Example 4

An emulsion for the magenta dye forming layer was prepared in the same manner as the preparation of Emulsion B except that the sensitizing dye I for green-sensitive emulsion was substituted for the sensitizing dye II for blue-sensitive emulsion. Further, an emulsion for the yellow dye forming layer was prepared in the same manner as the preparation of Emulsions 1-A to 1-D except that the sensitizing dye II for blue-sensitive emulsion was substituted for the sensitizing dye I for green-sensitive emulsion. Then, samples were prepared in the same manner as in Example 2 except that the above emulsion for the magenta dye forming layer was used in the magenta dye forming layer having medium sensitivity and the above emulsion for the yellow dye forming layer was used in the yellow dye forming layer having medium sensitivity. Then, the same tests as those for Example 2 were carried out to obtain good results and the effects of the present invention were confirmed.

An emulsion for the magenta dye forming layer was prepared in the same manner as the preparation of Emulsion G except that the sensitizing dye I for green-sensitive emulsion was substituted for the sensitizing dyes III to V for red-sensitive emulsion. Further, an emulsion for the cyan dye forming layer was prepared in the same manner as the preparation of Emulsions 1-A to 1-D except that the mixture of sensitizing dyes for red-sensitive emulsion which was used in Emulsion G was substituted for the sensitizing dye I for green-sensitive emulsion. Then, samples were prepared in the same manner as in Example 2 except that the above emulsion for the magenta dye forming layer was used in the magenta dye forming layer having medium sensitivity and the above emulsion for the cyan dye forming layer was used in the cyan dye forming layer having medium sensitivity. Then, the same tests as those for Example 2 were carried out to obtain good results and the effects of the present invention were confirmed.

Example 5

Emulsions 1-E to 1-H having high sensitivity were prepared in the same manner as the preparation of Emulsions 1-A to 1-D except that average diameter of spheres having the same grain volumes was adjusted to 0.86 μm. In addition, Emulsions 1-I to 1-L having low sensitivity were prepared in the same manner as the preparation of Emulsions 1-A to 1-D except that average diameter of spheres having the same grain volumes was adjusted to 0.49 μm. Further, Emulsions 2-A to 2-L were prepared in the same manner as the preparation of Emulsions 1-A to 1-L except that the sensitizing dye II for blue-sensitive emulsion was substituted for the sensitizing dye I for green-sensitive emulsion. Moreover, Emulsions 3-A to 3-L were prepared in the same manner as the preparation of Emulsions 1-A to 1-L except that the mixture of sensitizing dyes for red-sensitive emulsion which was used in Emulsion G was substituted for the sensitizing dye I for green-sensitive emulsion. Then, samples were prepared in the same manner as in Example 2 except that, when Emulsion 1-A was used in the magenta dye forming layer having medium sensitivity, Emulsions 1-E, 1-I, 2-A, 2-E, 2-I, 3-A, 3-E, 3-I were substituted for Emulsions A to H, and when Emulsion 1-B was used in the magenta dye forming layer having medium sensitivity, Emulsions 1-F, 1-J, 2-B, 2-F, 2-J, 3-B, 3-F, 3-J were substituted for Emulsions A to H, and when Emulsion 1-C was used in the magenta dye forming layer having medium sensitivity, Emulsions 1-G, 1-K, 2-C, 2-G, 2-K, 3-C, 3-G, 3-K were substituted for Emulsions A to H, and when Emulsion 1-D was used in the magenta dye forming layer having medium sensitivity, Emulsions 1-H, 1-L, 2-D, 2-H, 2-L, 3-D, 3-H, 3-L were substituted for Emulsions A to H. Then, the same tests as those for Example 2 were carried out to obtain good results and the effects of the present invention were confirmed.

What is claimed is:

1. A silver halide color photographic light-sensitive material comprising a substrate having thereon at least one photographic light-sensitive layer which comprises a light-sensitive silver halide emulsion, a developing agent, a compound capable of forming a dye by a coupling reaction with the oxidation product of the developing agent, and a binder, wherein the light-sensitive silver halide emulsion contains epitaxial silver halide grains in which at least a silver salt epitaxy is formed on the surface of silver bromide or silver iodobromide tabular grains acting as a host, wherein the content of silver chloride contained in the silver salt epitaxy is more than 20 mole %.

2. The silver halide color photographic light-sensitive material according to claim 1, wherein said developing agent is a compound represented by one of the following formulas I, II, III or IV Formula I

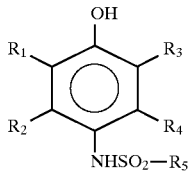

-continued

Formula II

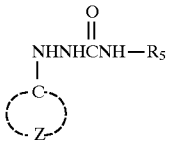

Formula III

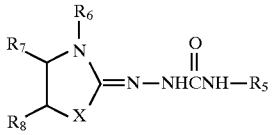

Formula IV

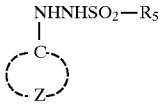

wherein, $R_1$ to $R_4$ represent a hydrogen atom, halogen atom, alkyl group, aryl group, alkylcarboxylic acid amide group, arylcarboxylic acid amide group, alkylsulfonamide group, arylsulfonamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or an acyloxy group, $R_5$ represents an alkyl group, aryl group or a heterocyclic group, Z represents an atomic group forming an aromatic ring, the total value of Hammett's constant (σ) for its substituent being more than 1 when Z is a benzene ring, $R_6$ represents an alkyl group, X represents an oxygen atom, sulfur group, selenium group or a tertiary nitrogen atom bonded to alkyl groups and/or aryl groups, $R_7$ and $R_8$ represent a hydrogen atom or a substituent, $R_7$ and $R_8$ may form a double bond or ring by bonding with each other and each of the formulae I to IV contains at least one ballast group having more than eight carbon atoms.

3. The silver halide color photographic light-sensitive material according to claim 1, wherein the tabular grains account for 50 to 100% of the total projected area of all the grains contained in the emulsion.

4. The silver halide color photographic light-sensitive material according to claim 3, wherein the average thickness of the tabular grains is 0.01 to 0.5 μm.

5. The silver halide color photographic light-sensitive material according to claim 3, wherein the average diameter of circles each having the same area as a projected area of a tabular grain is 0.3 to 5 μm.

6. The silver halide color photographic light-sensitive material according to claim 3, wherein the average aspect ratio of the tabular grains is 2 to 100.

7. The silver halide color photographic light-sensitive material according to claim 1, wherein the silver salt epitaxy is formed on the corners or edges of the tabular grains acting as a host.

8. The silver halide color photographic light-sensitive material according to claim 1, wherein the silver salt epitaxy is formed of a silver halide containing chloride ions.

9. A method of forming a color image comprising heating an imagewise exposed silver halide color photographic light-sensitive material of claim 1 at a temperature of 60° C. to 100° C. for 5 seconds to 60 seconds.

10. A method of forming of color image comprising heating an imagewise exposed silver halide color photographic light-heating said silver halide color photographic light-sensitive material of claim 2 at a temperature of 60° C. to 100° C. for 5 seconds to 60 seconds.

11. A method for forming images on silver halide color photographic light-sensitive materials comprising the steps of:

exposing imagewise a silver halide color photographic light-sensitive material comprising a substrate having thereon at least one photographic light-sensitive layer which comprises a light-sensitive silver halide emulsion, a developing agent, a compound capable of forming a dye by a coupling reaction with the oxidation product of the developing agent, and a binder;

wherein the light-sensitive silver halide emulsion contains epitaxial silver halide grains in which at least a silver salt epitaxy is formed on the surface of silver bromide or silver iodobromide tabular grains acting as a host, wherein the content of silver chloride contained in the silver epitaxy is more than 20 mole %;

placing said silver halide color photographic light-sensitive material and a processing material which comprises a support and a processing layer formed thereon and containing a base and/or base precursor, such that the photographic light-sensitive layer of said silver halide color photographic light-sensitive material and the processing layer of said processing material face each other, in the presence of water of an amount corresponding to from 1/10 to equivalent of an amount necessary for providing maximum swelling of all coated layers except the back layers of said silver halide color photographic light-sensitive material and said processing material; and heating said silver halide color photographic light-sensitive material and said processing material at 60° to 100° C. for 5 to 60 seconds.

* * * * *